US009441282B2

(12) United States Patent
Van Dorfy, Jr. et al.

(10) Patent No.: US 9,441,282 B2
(45) Date of Patent: Sep. 13, 2016

(54) FURNACE AND SYSTEM FOR HEAT TREATING MATERIAL

(71) Applicant: Lone Star Heat Treating Corporation, Houston, TX (US)

(72) Inventors: Michael R. Van Dorfy, Jr., Houston, TX (US); Clair J. Van Rooyen, Houston, TX (US); Kevin Bahrt, Houston, TX (US)

(73) Assignee: Lone Start Heat Treating Corporation, Houston, TX (US)

( * ) Notice: Subject to any disclaimer, the term of this patent is extended or adjusted under 35 U.S.C. 154(b) by 195 days.

(21) Appl. No.: 14/137,606

(22) Filed: Dec. 20, 2013

(65) Prior Publication Data

US 2015/0176099 A1 Jun. 25, 2015

(51) Int. Cl.

| | |
|---|---|
| ***C21D 9/00*** | (2006.01) |
| ***F27B 9/10*** | (2006.01) |
| ***F27B 9/20*** | (2006.01) |
| ***F27B 9/30*** | (2006.01) |
| ***F27B 9/38*** | (2006.01) |
| *C21D 9/46* | (2006.01) |

(52) U.S. Cl.
CPC ..... *C21D 9/0062* (2013.01); *F27B 9/10* (2013.01); *F27B 9/20* (2013.01); *F27B 9/30* (2013.01); *F27B 9/38* (2013.01); *C21D 9/0025* (2013.01); *C21D 9/46* (2013.01)

(58) Field of Classification Search
CPC ..... C21D 9/0062; C21D 9/0025
USPC ..... 266/256
See application file for complete search history.

(56) References Cited

U.S. PATENT DOCUMENTS

| | | | | |
|---|---|---|---|---|
| 2,254,891 A * | 9/1941 | Germany | C21D 9/00 | 266/256 |
| 2,426,718 A * | 9/1947 | Vanek | C21D 9/0018 | 266/130 |
| 2015/0176099 A1* | 6/2015 | Van Dorfy, Jr. | C21D 9/0062 | 148/400 |

* cited by examiner

*Primary Examiner* — Scott Kastler
(74) *Attorney, Agent, or Firm* — Chamberlain, Hrdlicka

(57) ABSTRACT

A furnace for heat treating material, and a system including the furnace, includes an outer support frame and an inner shell. The inner shell is connected to and at least partially received within the outer support frame. Further, the outer support frame and the inner shell are movable to open and close to receive and remove material from the inner shell.

19 Claims, 28 Drawing Sheets

FURNACE AND SYSTEM FOR HEAT TREATING MATERIAL

BACKGROUND

The common approach for heat treating materials, such as metallic substances that include iron based alloys, is to place the material in or pass the material through a gas-fired furnace, or other form of ambient heating furnace or induction furnace that heats the material to the desired heat treatment temperature. As such, the materials may experience either a batch-type heat treatment process, in which the materials experience a stage-by-stage form of heat treatment, or a continuous-type heat treatment process, in which the materials experience a heat treatment process that includes a continuous motion for the materials to undergo different heat treatment techniques.

For example, when heat treating steel, the steel may be passed through or placed within a gas-fired or induction furnace for purposes of heating. The steel may then be removed from or exit the furnace to either be cooled or quenched according to various known techniques to achieve the desired physical properties in the steel depending upon whether the steel has been heated above or below its transformation temperature or selected critical temperatures thereof. However, very substantial capital investment is needed to provide a gas-fired furnace and other related equipment of the size that is capable of heat treating metallic tubular members, steel sheets, or the like. Further, the maintenance of such equipment may bring about other challenges to lengthen the life expectancy of such equipment.

BRIEF DESCRIPTION OF THE DRAWINGS

For a detailed description of the preferred embodiments of the invention, reference will now be made to the accompanying drawings in which.

DETAILED DESCRIPTION

Figure 1A:
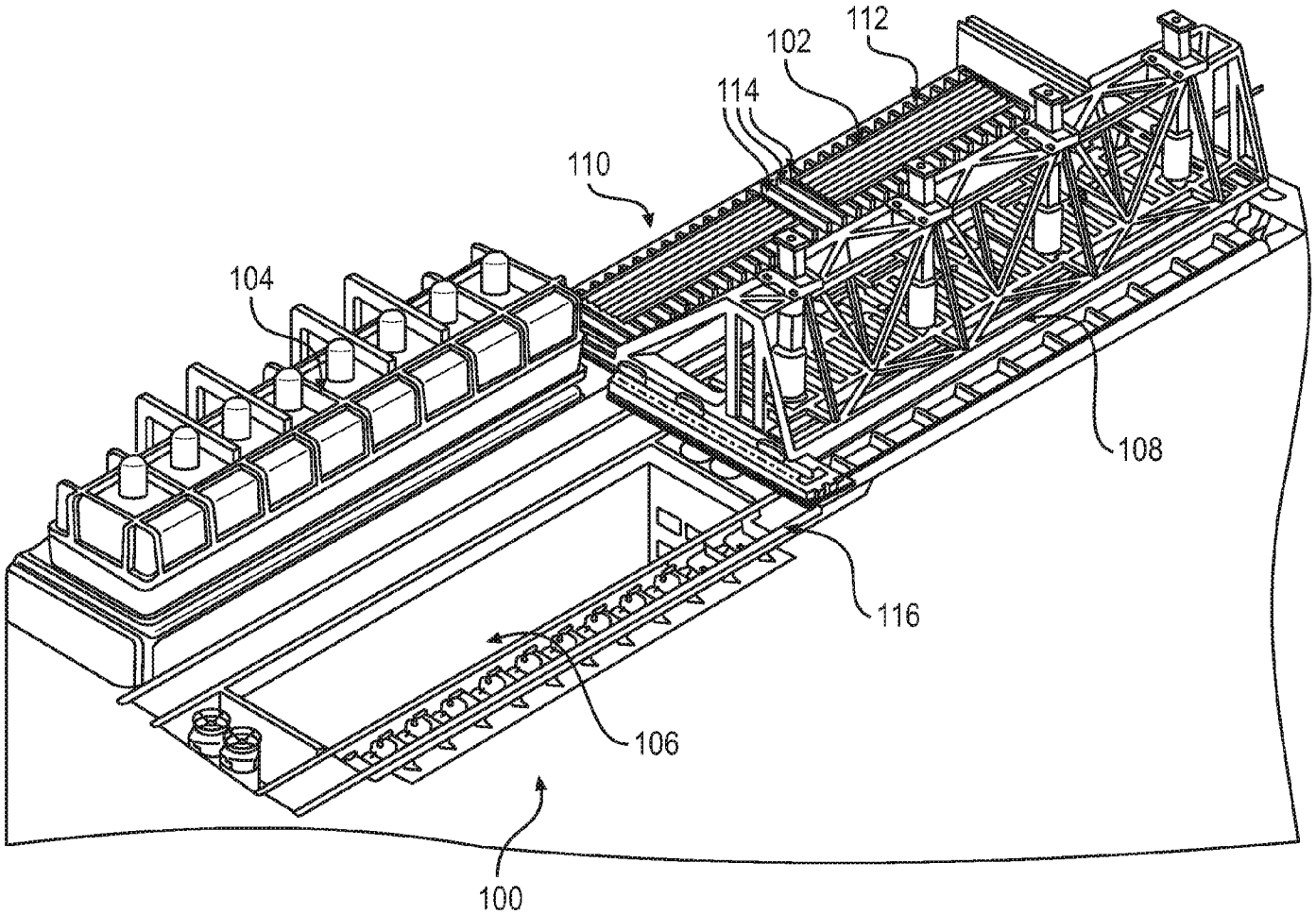
FIG. 1A shows an above perspective view of a system for heat treating material as material is received upon a material loading station in accordance with one or more embodiments of the present disclosure.

The following discussion is directed to various embodiments of the invention. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not structure or function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," "higher," "lower," and variations of these terms is made for convenience, but does not require any particular orientation of the components.

One or more aspects of the present disclosure relate to a furnace, and a system including a furnace, for heat treating material. The furnace includes an outer support frame with an inner shell connected to and at least partially received within the outer support frame, in which the outer support frame and the inner shell movable to open and close to receive and remove material from the inner shell. The outer support frame may include rib assemblies and support members. The rib assemblies may each extend about at least a portion of the inner shell, with the support members connected across the rib assemblies to connect the rib assemblies to each other. The inner shell may include replaceable panels connected to each other and connected to the outer support frame, for example, such that the panels may be replaceable within the inner shell for maintenance. The inner shell may further include at least one exhaust flute operably coupled thereto, at least one gas burner operably coupled thereto, and at least one air blower operably coupled thereto. The furnace may further include at least one actuator and/or an arm assembly operably coupled thereto to open and close the outer support frame and the inner shell.

The system for heat treating material includes a furnace movable to open and close to receive and remove material therefrom, the furnace including an outer support frame and an inner shell connected thereto. The system further includes a quench tank to receive material therein, and a manipulator assembly to transport and move material between the furnace and the quench tank. The system may further include a material loading station, in which the manipulator assembly is configured to move between the furnace, the quench tank, and the material loading station.

The manipulator assembly may include a transfer car configured to move the manipulator assembly along a track between the furnace, the quench tank, and the material loading station, a fork assembly configured to receive and dispatch material from the manipulator assembly, and a carriage frame configured to movably couple the fork assembly to the transfer car. The manipulator assembly may further include at least one telescoping assembly coupled between the fork assembly and the carriage frame to move the fork assembly with respect to the carriage frame, such as to move the fork assembly vertically with respect to the carriage frame, and at least one actuator coupled between the carriage frame and the transfer car to move the carriage frame with respect to the transfer car, such as to move the carriage frame horizontally with respect to the transfer car.

Further, the quench tank may include agitators. At least one of the agitators may include multiple ports, and at least one of the agitators may be positioned at an end of the quench tank. Furthermore, in accordance with one or more embodiments of the present disclosure, the furnace and the system may be capable of heat treating material, such as a tubular member, having a length between about 25 feet (about 7.6 meters) and about 55 feet (about 16.8 meters).

Referring now to FIGS. 1A-1L, multiple perspective views of a system 100 for heat treating material 102 in accordance with one or more embodiments of the present disclosure are shown. In particular, FIGS. 1A-1L show a method of operation of the system 100, such as when heat treating the material 102 in accordance with a method of the present disclosure. The system 100 includes a furnace 104, a quench tank 106, and a manipulator assembly 108. The system 100 may further include a material loading station 110.

The furnace 104 may be able to apply heat to the material 102 during the heat treatment process, and therefore the furnace 104 is able to open and close to receive and remove the material 102 therefrom. The quench tank 106 may be used for quenching, or rapidly cooling, the material 102, and therefore the quench tank 106 may be used to retain a quenching medium therein, such as water, polymer, oil, and/or other quenching medium known in the art, to receive the material 102 when quenching. The material loading station 110, if included, may be used to receive the material 102 within the system 100, such as before the heat treatment of the material 102, and may be used to receive the material 102 also after heat treatment through the system 100. Further, the manipulator assembly 108 may be used to transport and move the material 102 between the different stations and points within the system 100. As such, the manipulator assembly 108 may be able to receive and dispatch the material 102, may be able to move between the furnace 104, the quench tank 106, and the material loading station 110, and may be able to raise and lower the material 102 as necessary within the system 100.

As shown in FIG. 1A, the material 102 may be initially delivered or set on the material loading station 110. The material loading station 110 may include a heat-resistant surface 112, such as a surface formed of or including hearth and/or other heat-resistant or heat-tolerant material, in which the heat-resistant surface 112 that includes one or more ridges 114 formed therein.

Figure 1B:
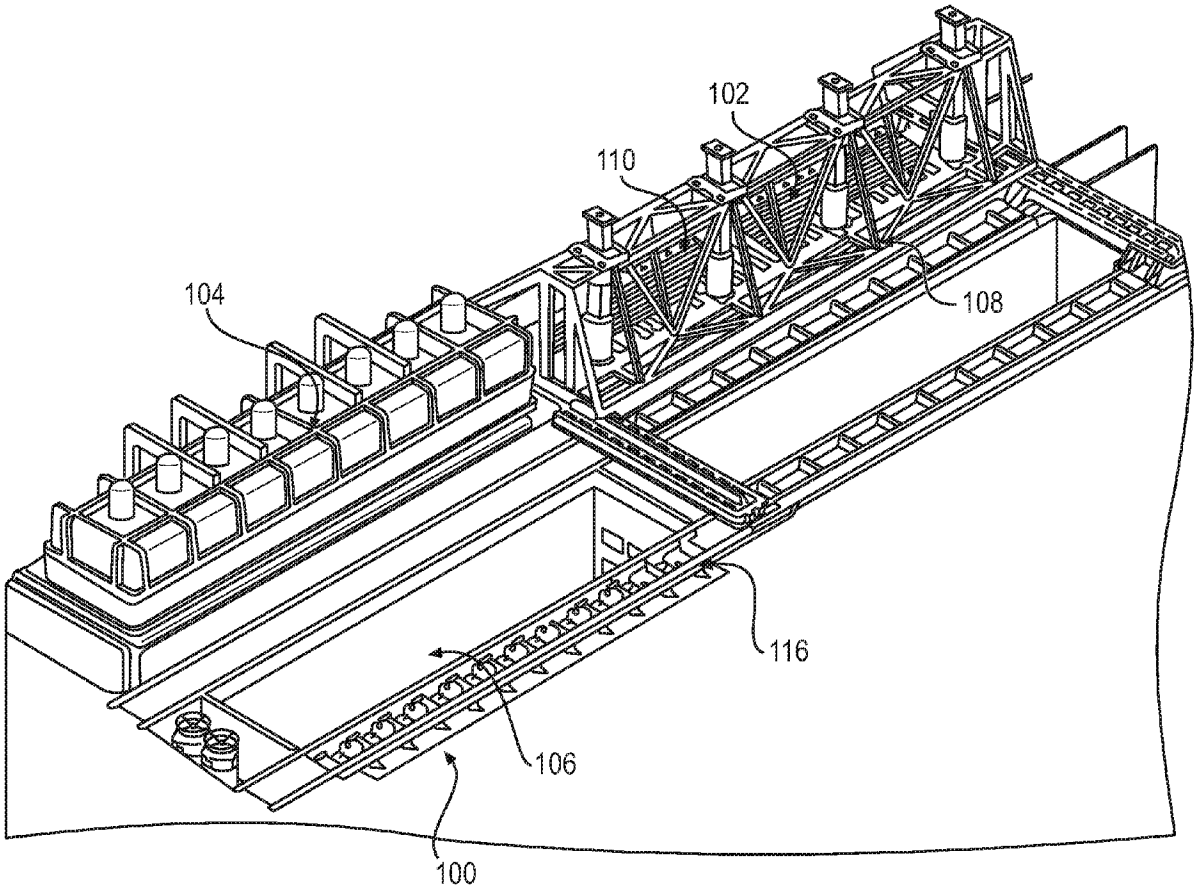
FIG. 1B shows an above perspective view of the system for heat treating material as material is received upon a manipulator assembly in accordance with one or more embodiments of the present disclosure.
Figure 1C:
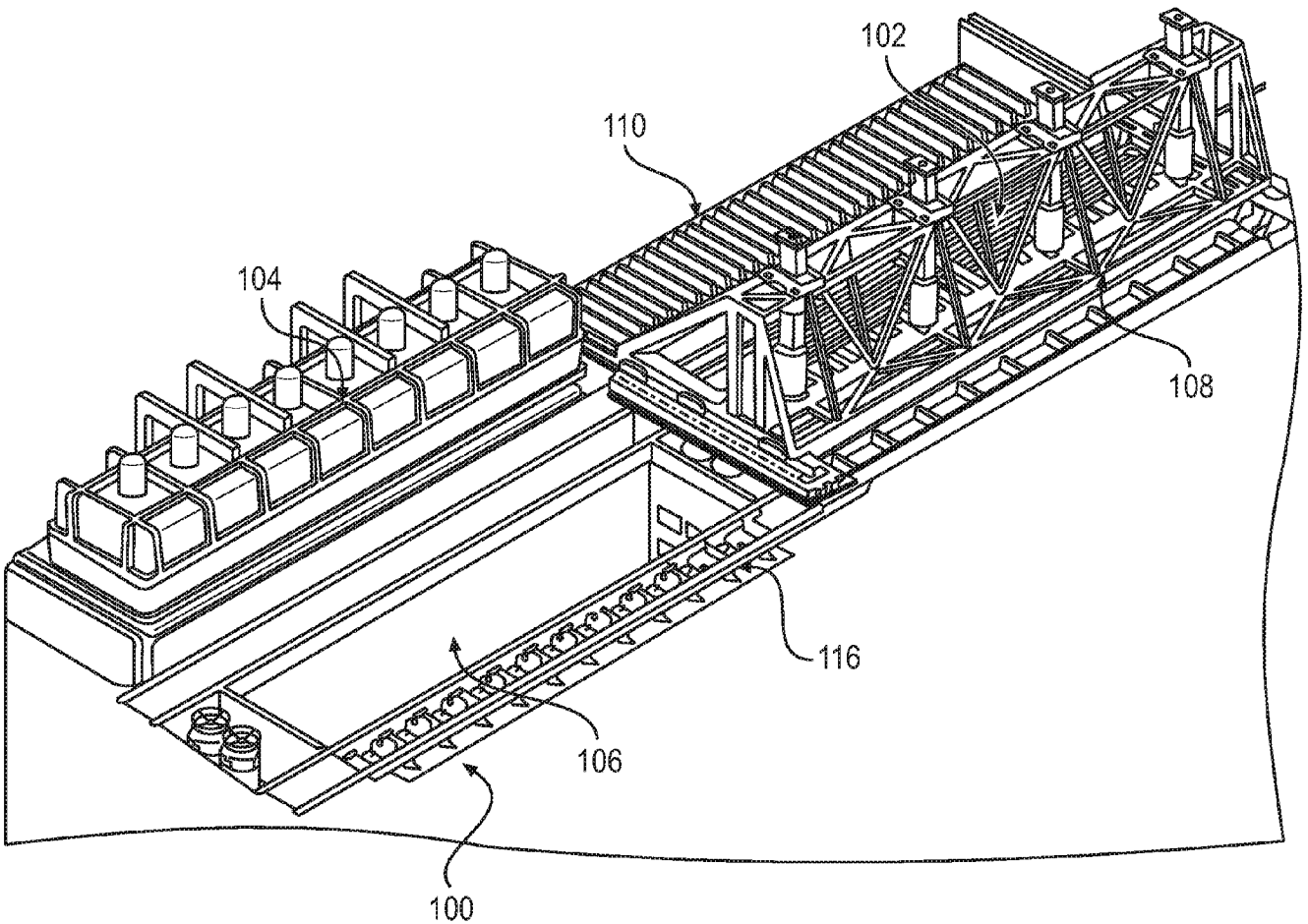
FIG. 1C shows an above perspective view of the system for heat treating material as material is transported by the manipulator assembly away from the material loading station in accordance with one or more embodiments of the present disclosure.

As shown between FIGS. 1A, 1B, and 1C, the manipulator assembly 108 may move from a rest position to then interact with the material loading 110 to receive the material 102 onto the manipulator assembly 108 from the material loading station 110. The ridges 114 may be included within the material loading station 110 to enable the manipulator assembly 108 to receive the material from the loading station 110, such as by having a fork assembly (discussed more below) of the manipulator assembly 108 enter into the ridges 114 from a side of the material loading station 110 and then lift from underneath the material 102 to receive the material 102 into the manipulator assembly 108.

Figure 1D:
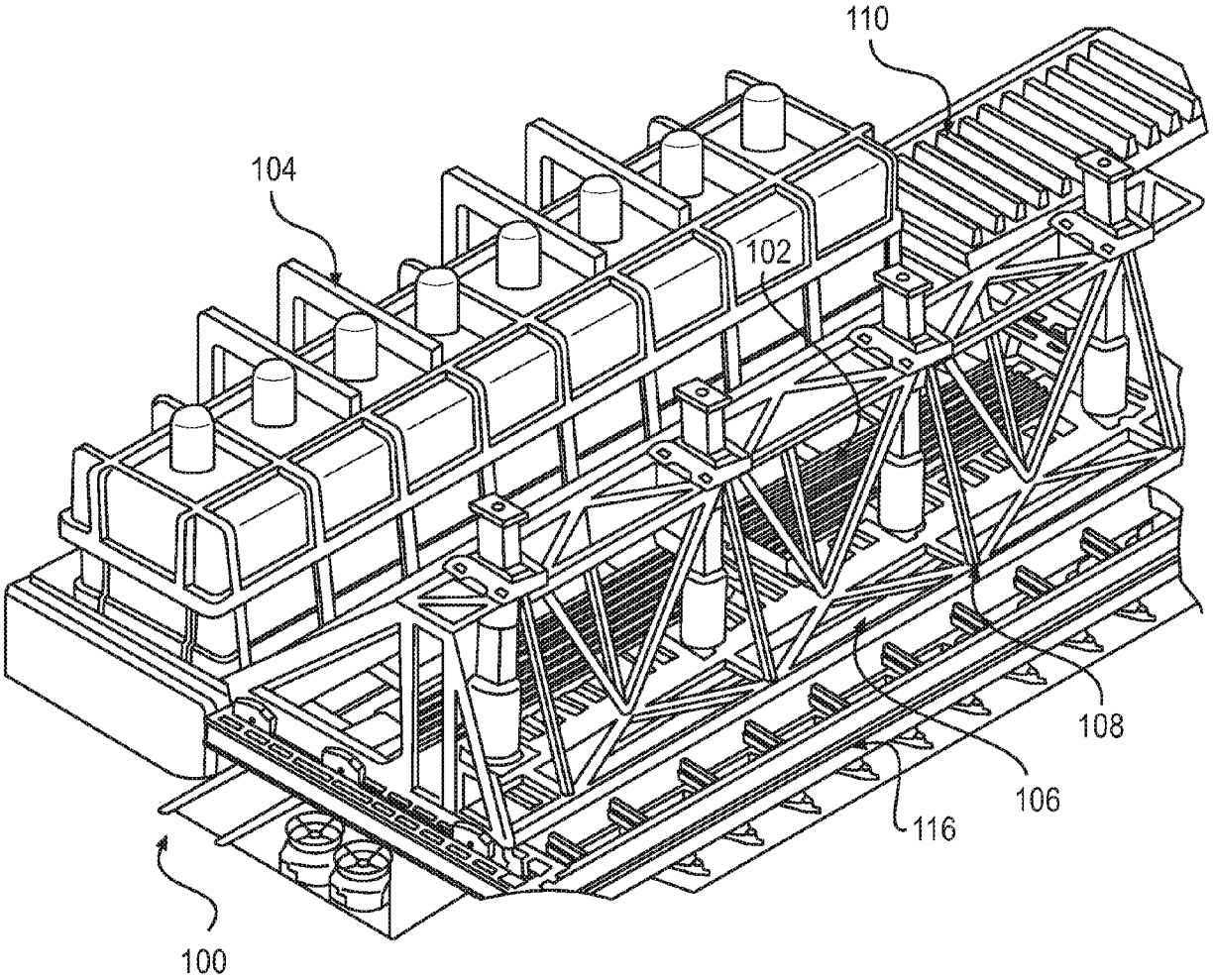
FIG. 1D shows an above perspective view of the system for heat treating material as material is transported by the manipulator assembly towards the furnace in accordance with one or more embodiments of the present disclosure.
Figure 1E:
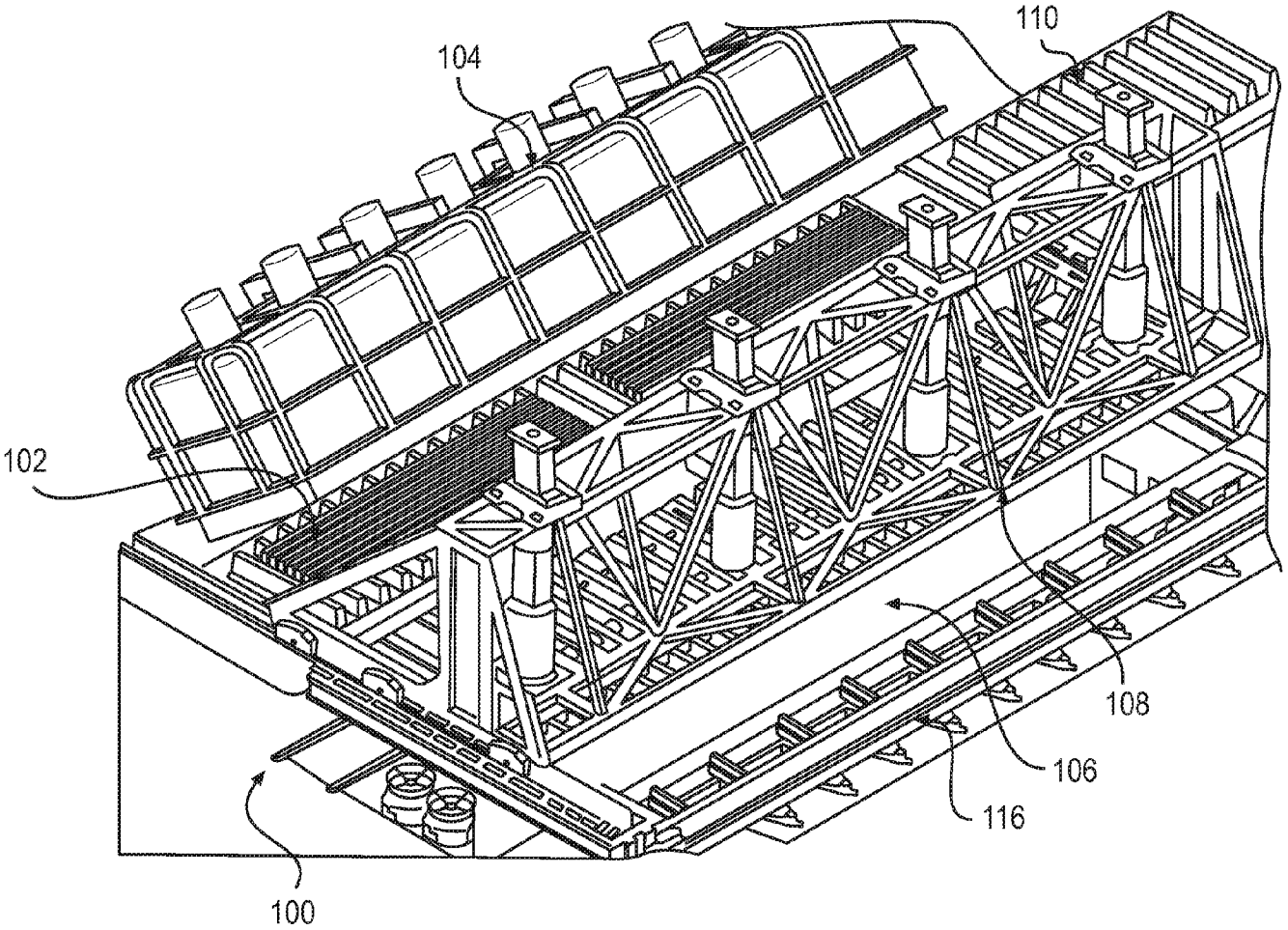
FIG. 1E shows an above perspective view of the system for heat treating material as material is received from the manipulator assembly into the furnace in accordance with one or more embodiments of the present disclosure.
Figure 1F:
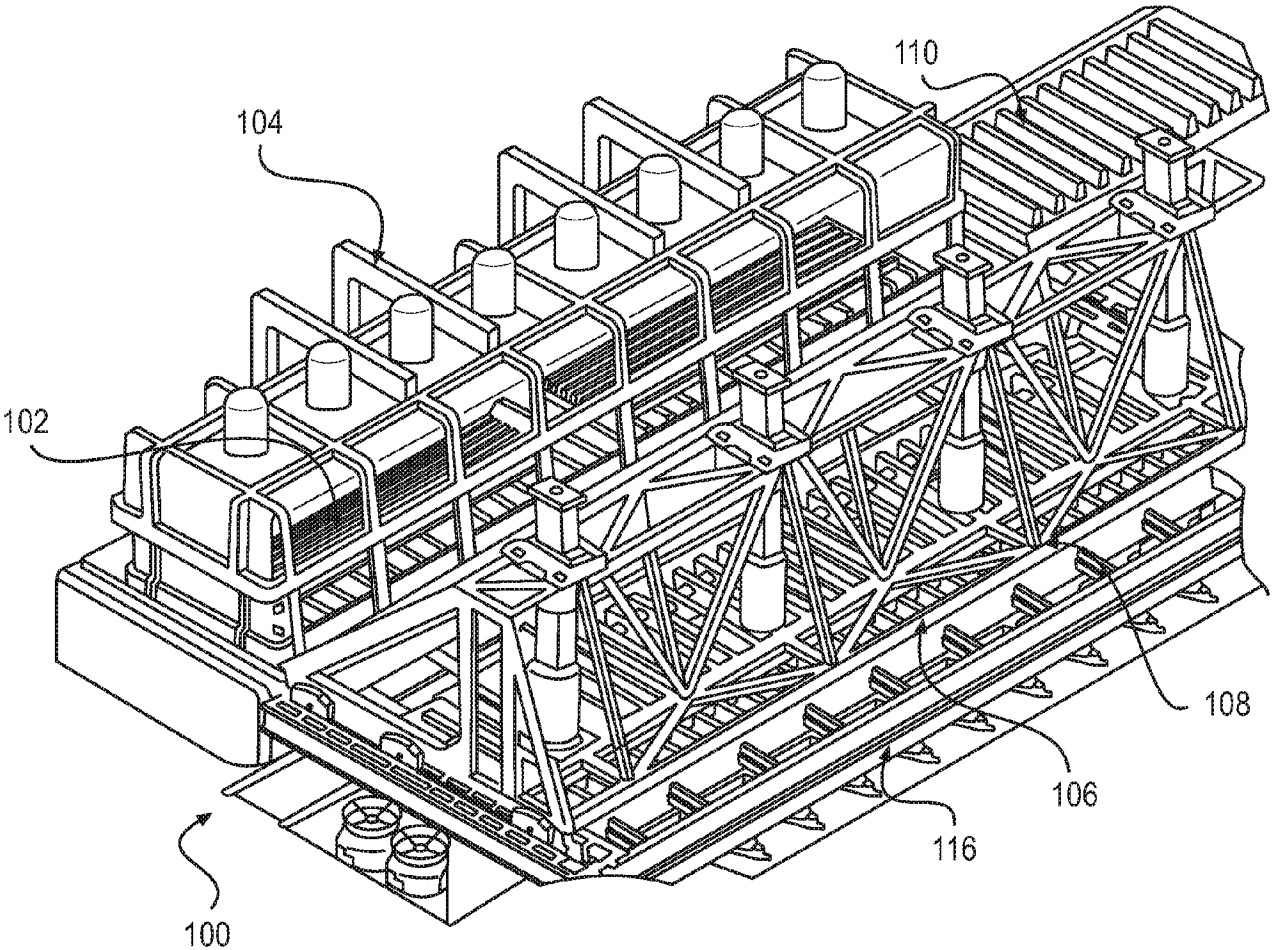
FIG. 1F shows an above perspective view of the system for heat treating material as material heat treated within the furnace in accordance with one or more embodiments of the present disclosure.
Figure 1G:
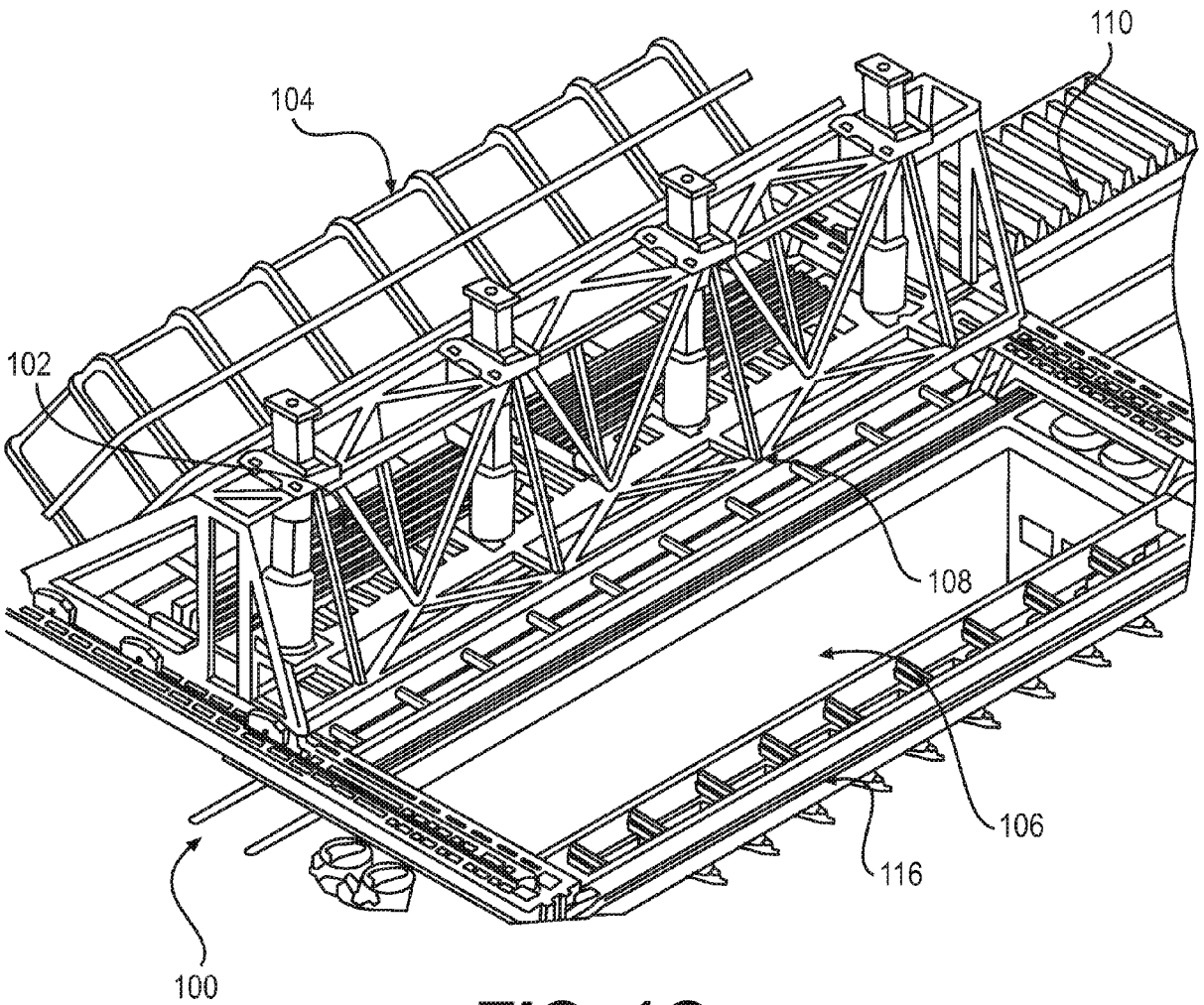
FIG. 1G shows an above perspective view of the system for heat treating material as material is received by the manipulator assembly from the furnace in accordance with one or more embodiments of the present disclosure.

As shown in FIG. 1D, the manipulator assembly 108 may move away from the material loading station 110 with the material 102 received thereupon, in which the manipulator assembly 108 may then move, such as along tracks 116, to be adjacent the furnace 104. The furnace 104 may then open, as shown in FIG. 1E, to receive the material 104 from the manipulator assembly 108. As such, the furnace 104 may include a heat-resistant surface 118, such as a surface formed of or including hearth and/or other heat-resistant or heat-tolerant material. The heat-resistant surface 118 may include one or more ridges formed therein, such as to facilitate receiving and removing the material 102 for the furnace 104. Further, though only a bottom surface is shown as the heat resistant surface 118, the furnace 104 may include other heat resistant surfaces, such as one or more of the side surfaces or the upper surface, to facilitate heating the material 102 within the furnace 104. Accordingly, as shown in FIG. 1F, the furnace 104 may close to heat the material 102 to a desired temperature for a desired amount of time. Upon completion of the heating of the material 102, the furnace 104 may then open again, as shown in FIG. 1G, in which the manipulator assembly 108 may move to interact with the furnace 104 again to receive the material 102 onto the manipulator assembly 108.

Figure 1H:
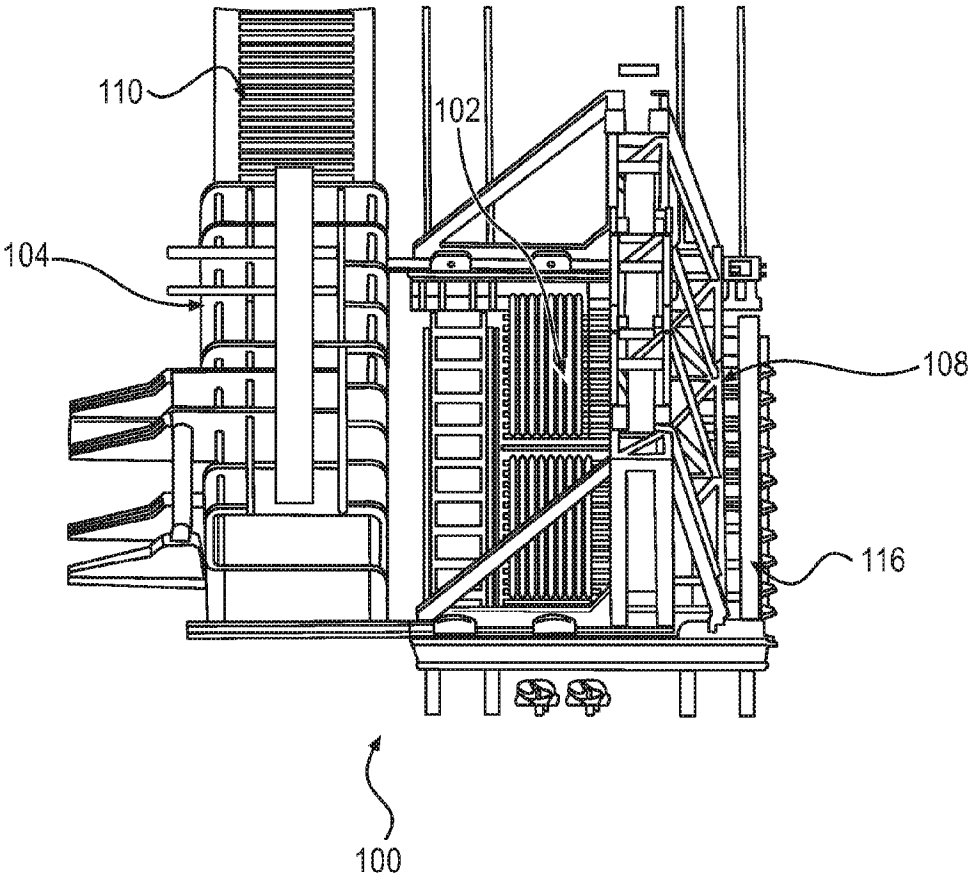
FIG. 1H shows an above perspective view of the system for heat treating material as material is positioned by the manipulator assembly above the quench tank in accordance with one or more embodiments of the present disclosure.
Figure 1I:
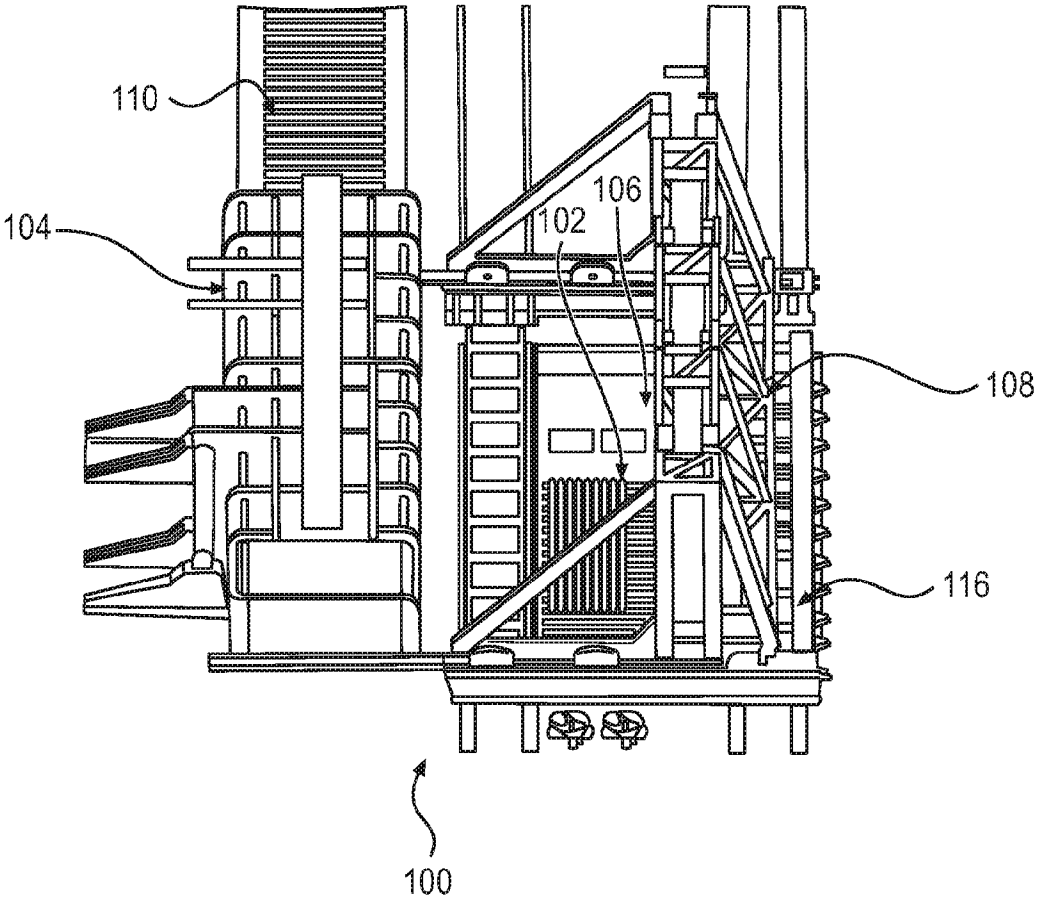
FIG. 1I shows an above perspective view of the system for heat treating material as material is received from the manipulator assembly into the quench tank in accordance with one or more embodiments of the present disclosure.

As shown in FIGS. 1H and 1I, after the material 102 has been heated within the furnace 104, the material 102 may be moved adjacent the quench tank 106 for quenching. In particular, as shown, the manipulator assembly 108 may move over the quench tank 106, in which the manipulator assembly 108 may lower the material 102, such as by lowering the fork assembly of the manipulator assembly 108 supporting the material 102, into the quench tank 106. As such, the quench tank 106 may be used to cool the material 102 therein within a desired quenching medium at a desired temperature for a desired amount of time. Upon completion of quenching of the material 102, the manipulator assembly 108 may raise the material 102, such as by raising the fork assembly of the manipulator assembly 108 supporting the material 102, from the quench tank 106.

Figure 1J:
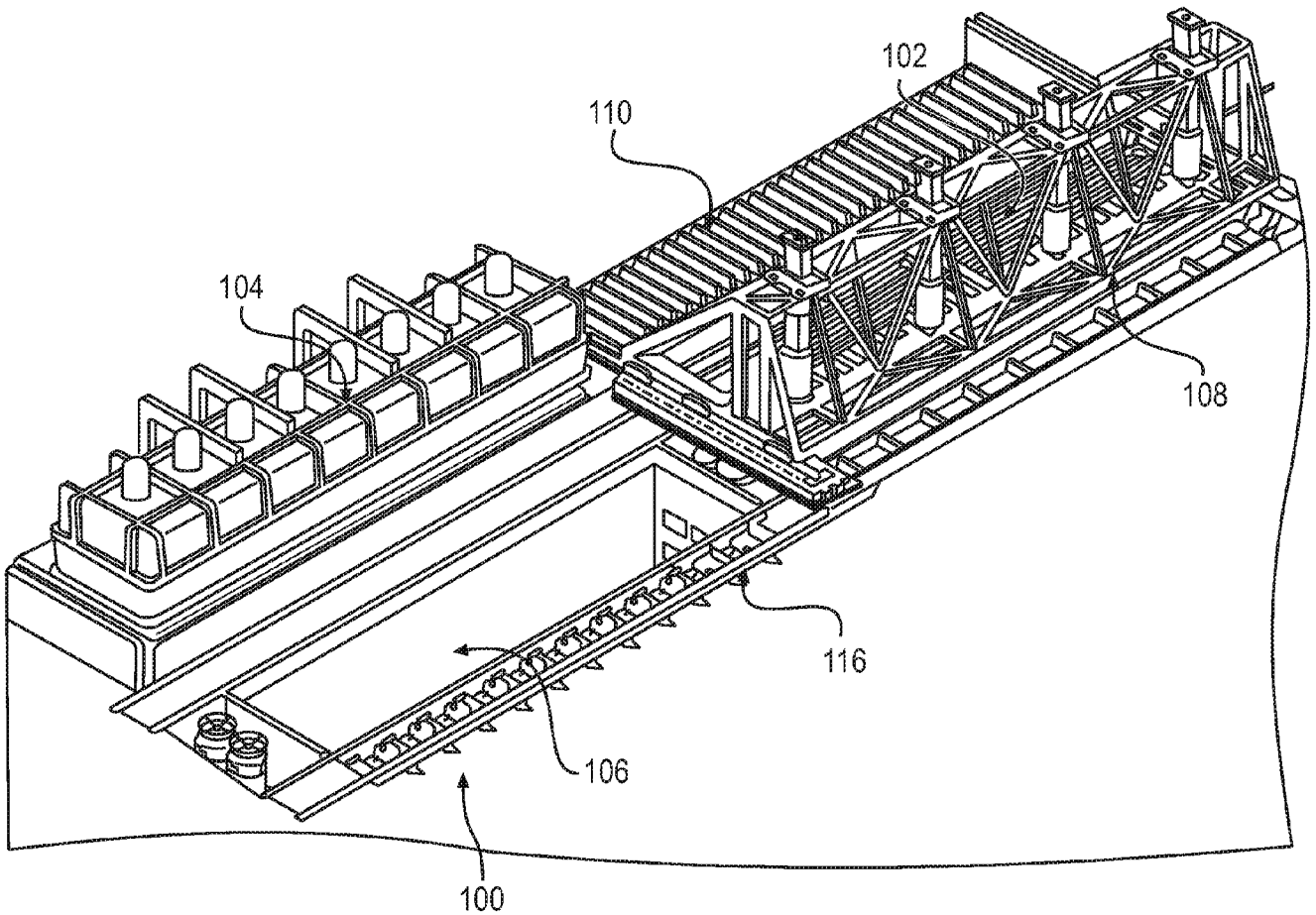
FIG. 1J shows an above perspective view of the system for heat treating material as material is transported by the manipulator assembly towards the material loading station in accordance with one or more embodiments of the present disclosure.
Figure 1K:
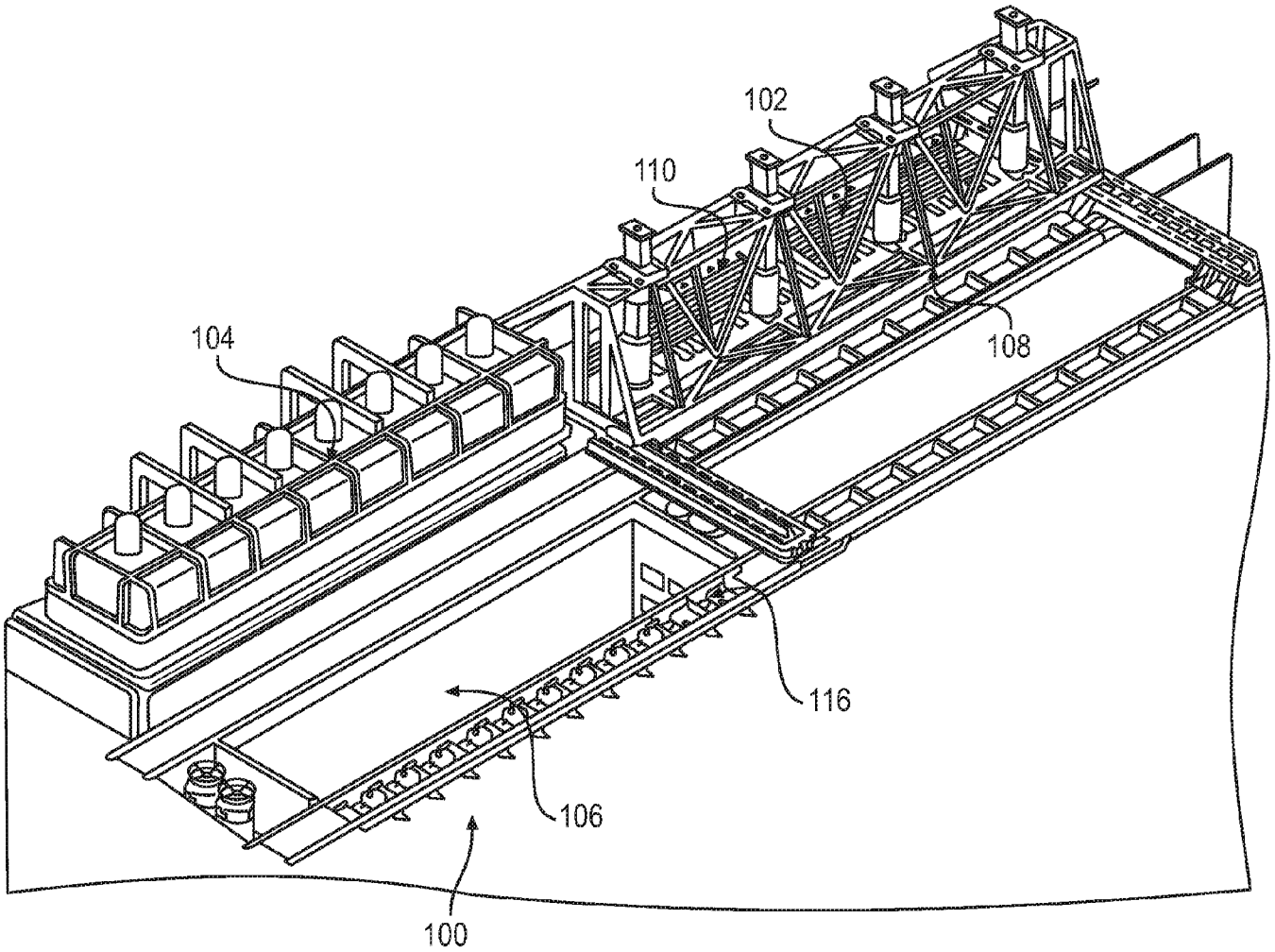
FIG. 1K shows an above perspective view of the system for heat treating material as material is received from the manipulator assembly onto the material loading station in accordance with one or more embodiments of the present disclosure.
Figure 1L:
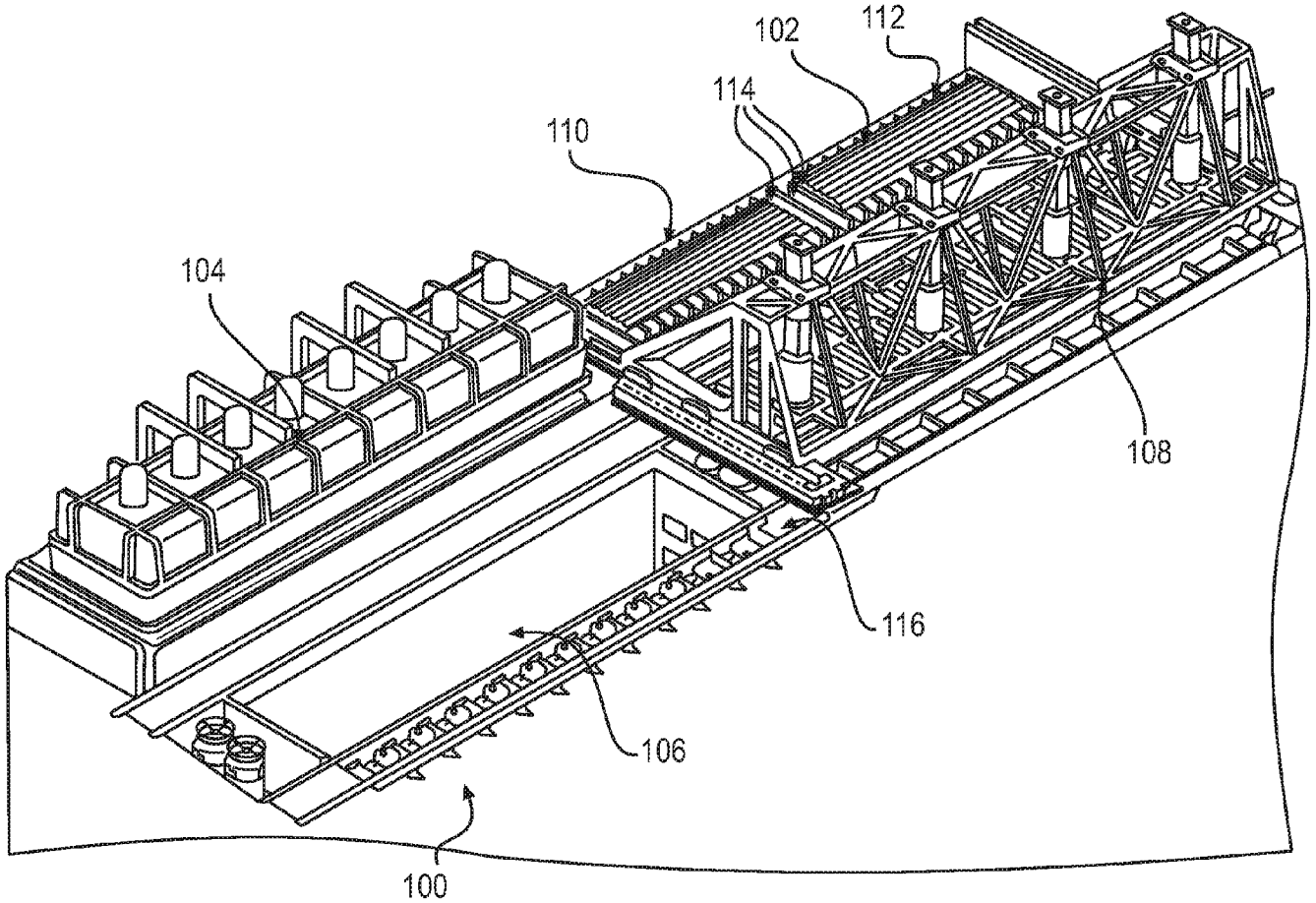
FIG. 1L shows an above perspective view of a system for heat treating material as material that is heat treated is positioned upon the material loading station in accordance with one or more embodiments of the present disclosure.

Depending on the desired characteristics for the material 102, the material 102 may receive additional heating, quenching, and/or cooling. For example, the system 100 may repeat heating the material 102 within the furnace 104 and quenching the material within the quench tank 106, as shown in FIGS. 1D-1J. Upon completion of the heating and quenching of the material 102, as shown in FIGS. 1J, 1K, and 1L, the manipulator assembly 108 may then move away from the quench tank 106 to return the material 102 to the material loading station 110, such as for additional cooling and/or to have the material 102 collected for distribution and/or other post heat treatment processes.

Figure 2A:
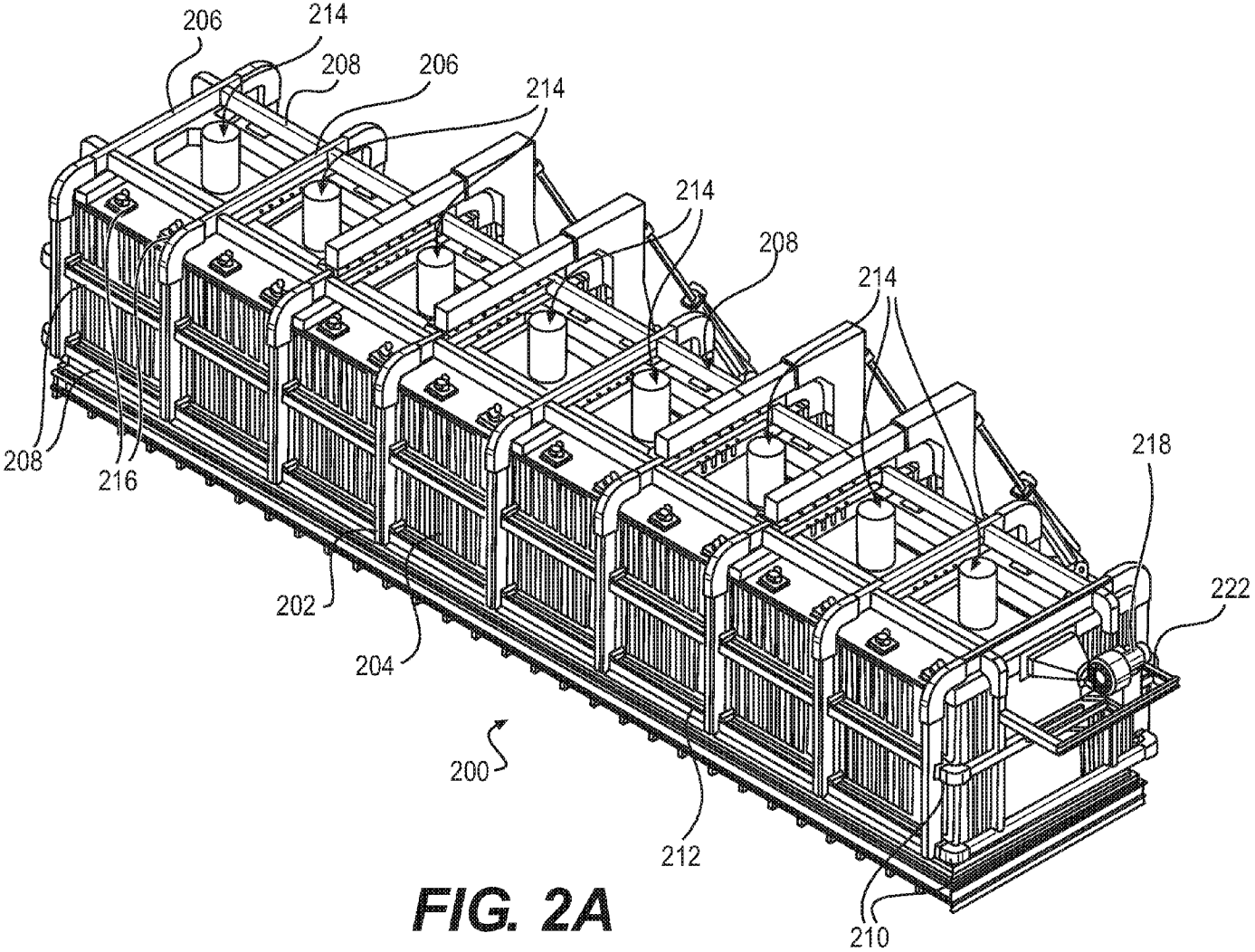
FIG. 2A shows an above perspective view of a furnace for heat treating material in a closed position in accordance with one or more embodiments of the present disclosure.
Figure 2B:
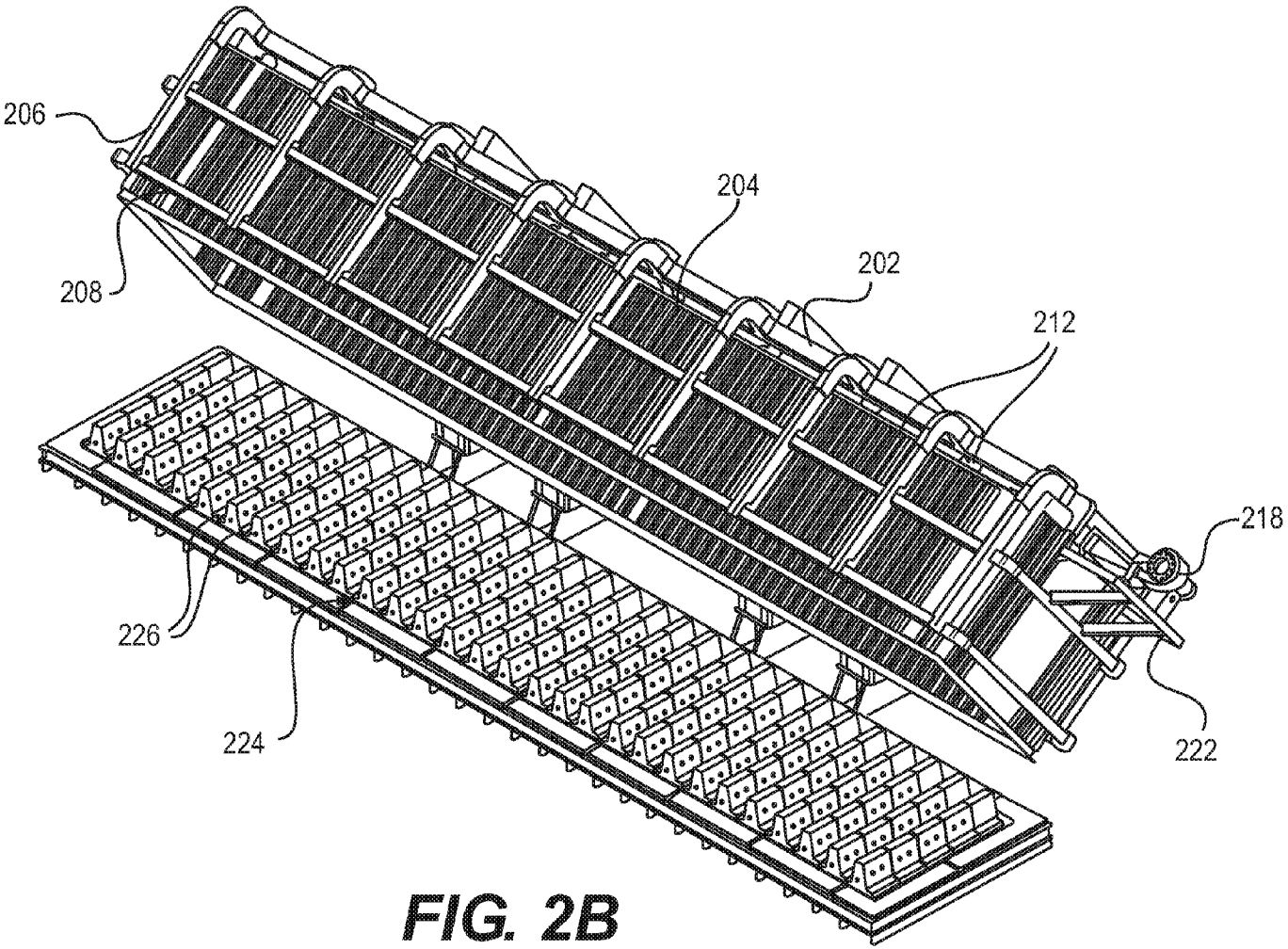
FIG. 2B shows an above perspective view of the furnace for heat treating material in an open position in accordance with one or more embodiments of the present disclosure.

Referring now to FIGS. 2A-2F, multiple views of a furnace 200 and components thereof in accordance with one or more embodiments of the present disclosure are shown. As discussed above, the furnace 200 may be movable to open and close to receive and remove material therefrom for heating. Accordingly, FIG. 2A shows the furnace 200 in the closed position, and FIG. 2B shows the furnace 200 in the open position.

The furnace 200 may include an outer support frame 202 with an inner shell 204 connected to the outer support frame 202. The inner shell 204 may also be received, such as at least partially received, within the outer support frame 202 such that the outer support frame 202 supports and reinforces the inner shell 204. FIGS. 2D, 2E, and 2F show multiple views of the outer support frame 202. As shown, the outer support frame 202 may include rib assemblies 206 and support members 208. The rib assemblies 206 may be arranged along the length of the inner shell 204 of the furnace 200, such as equally spaced therealong, with the rib assemblies 206 extending about and around the inner shell 204. For example, though the present disclosure is not so limited, the rib assemblies 206 are shown as extending about and around three sides of the inner shell 204. The support members 208 may then be connected across and between the rib assemblies 206, thereby connecting the rib assemblies 206 to each other to form the outer support frame 202. The support members 208 may extend across side surfaces and/or the top surface of the inner shell 204, as shown, to connect adjacent rib assemblies 206. Further, in one or more embodiments, the rib assemblies 206 may have one or more recesses 210 formed therein. As such, one or more of the support members 208 may connect, directly or indirectly, to the recesses 210 such that the support members 208 may be supported from the recesses 210 of the rib assemblies 206.

Figure 2C:
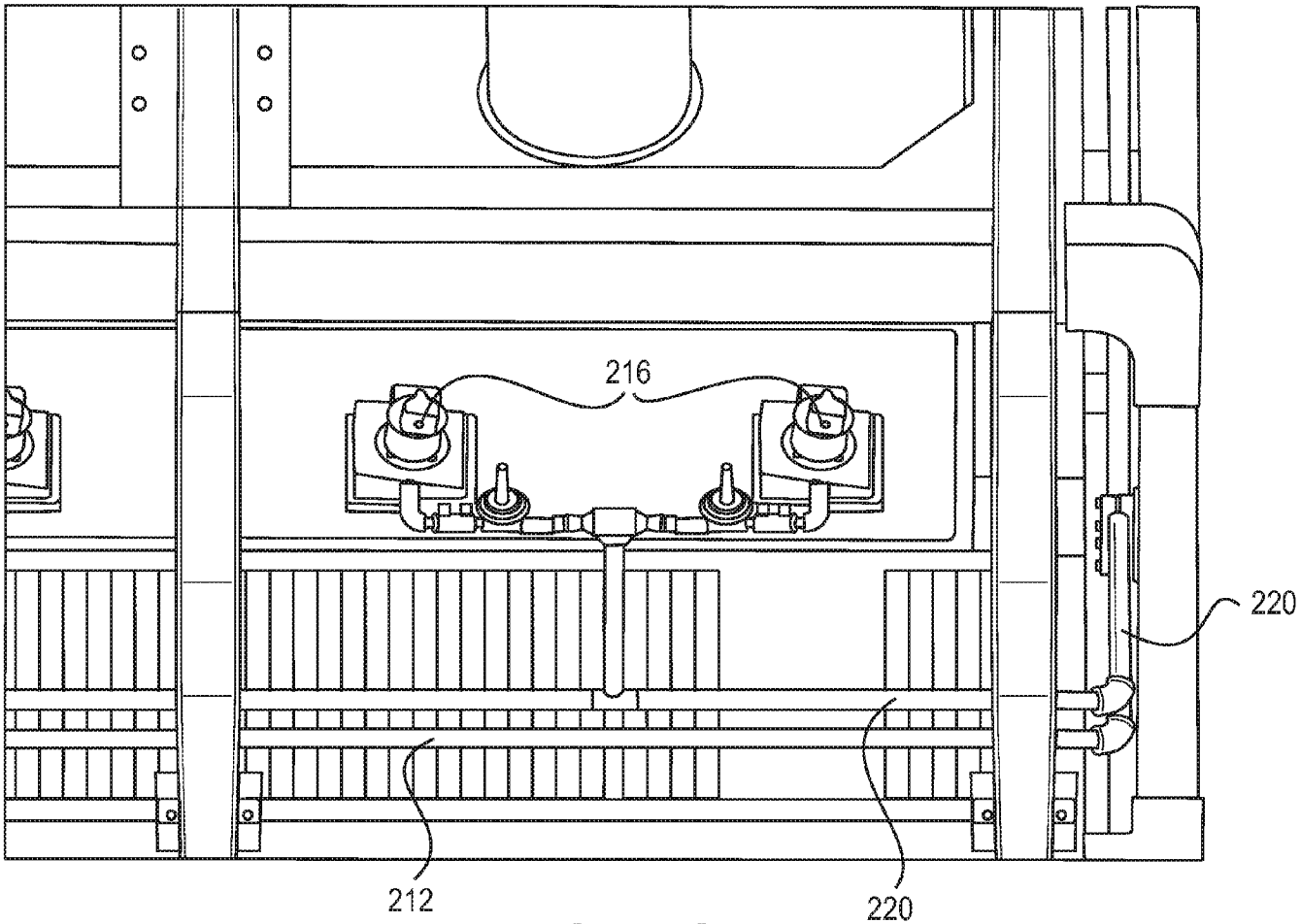
FIG. 2C shows an above perspective view of the furnace for heat treating material including gas burners and tubing in accordance with one or more embodiments of the present disclosure.
Figure 2D:
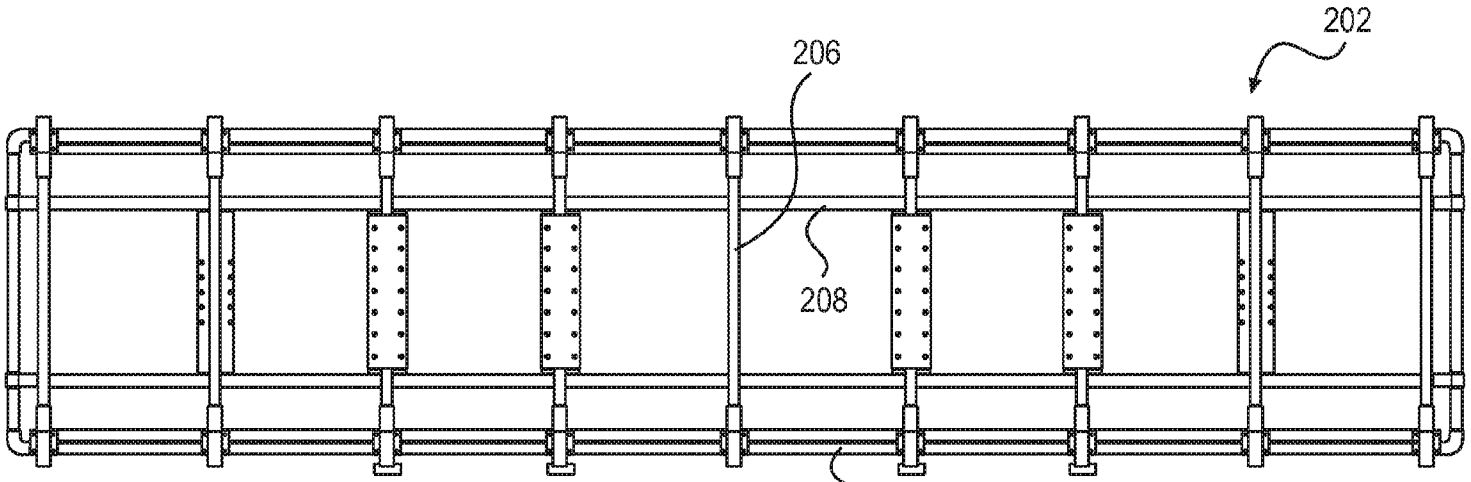
FIG. 2D shows an above perspective view of an outer support of the furnace for heat treating material in accordance with one or more embodiments of the present disclosure.
Figure 2E:
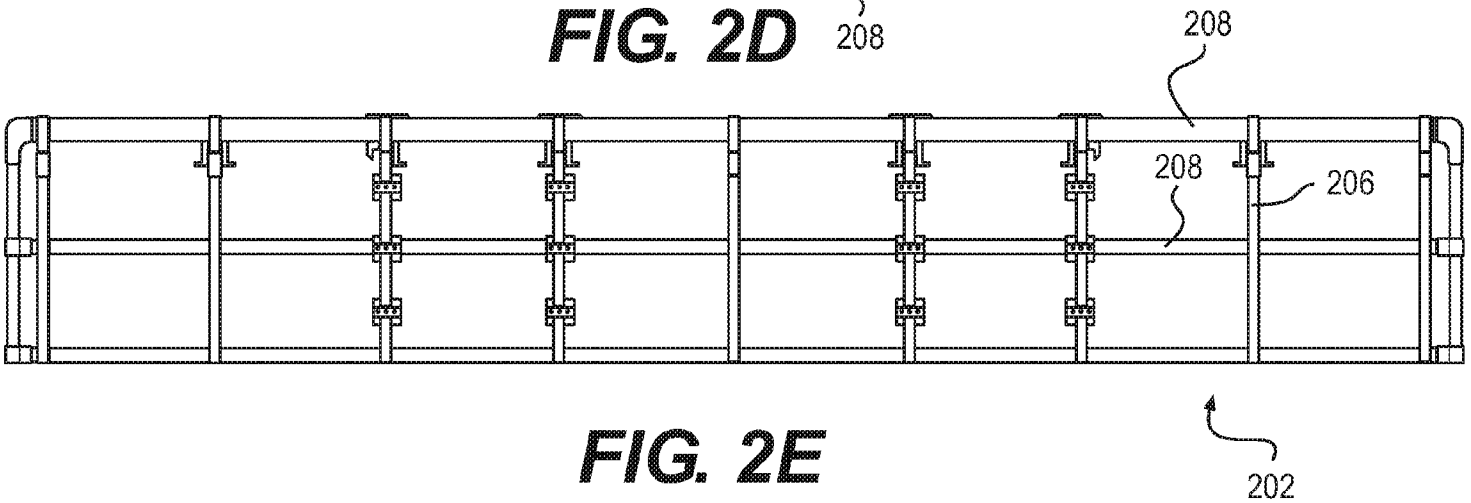
FIG. 2E shows a side perspective view of an outer support of the furnace for heat treating material in accordance with one or more embodiments of the present disclosure.
Figure 2F:
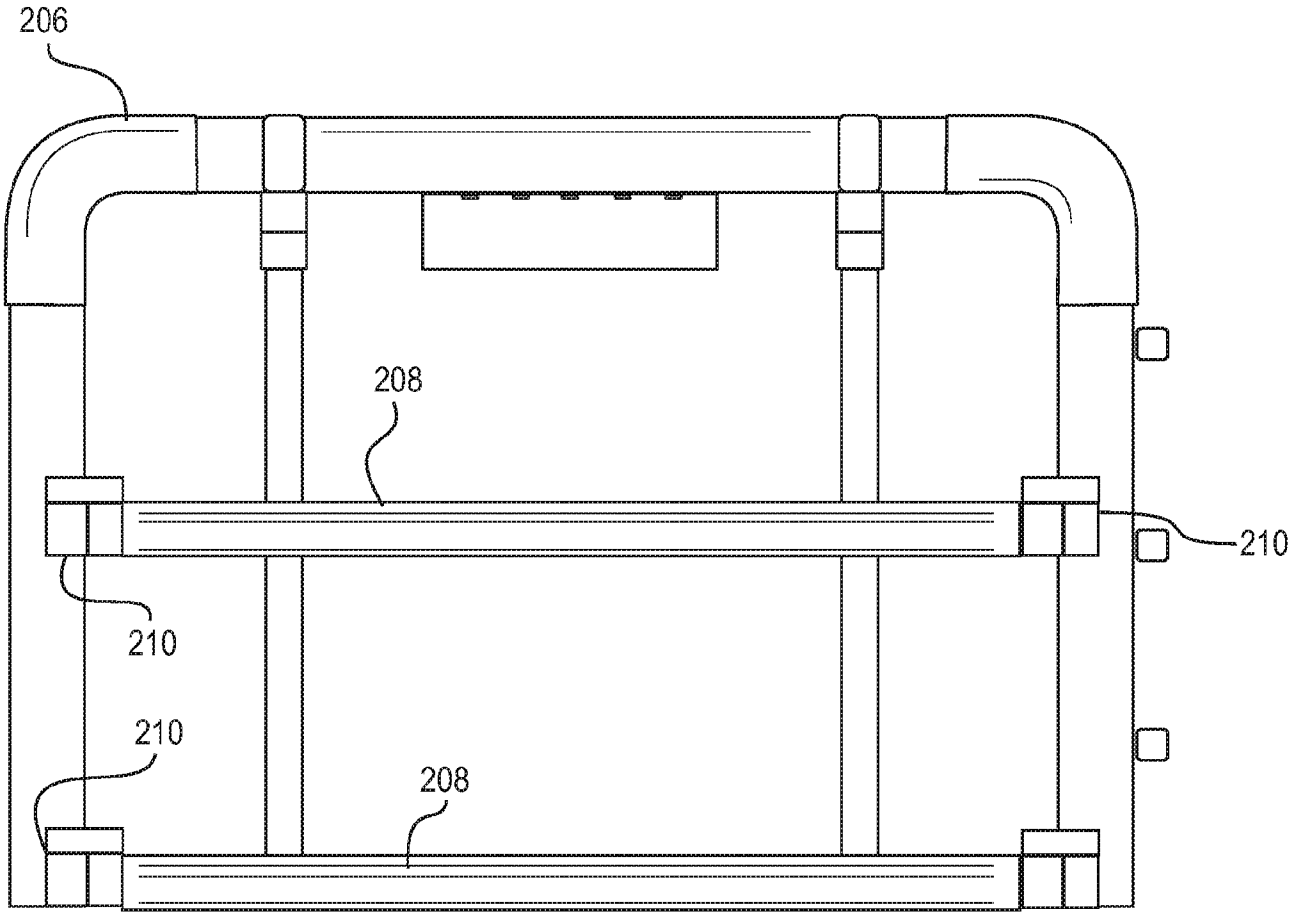
FIG. 2F shows an end perspective view of an outer support of the furnace for heat treating material in accordance with one or more embodiments of the present disclosure.

With reference to FIGS. 2A, 2B, and 2C, the inner shell 204 of the furnace 200 may include and/or be formed from replaceable panels 212. The panels 212 may be connected to each other, such as through connection members (e.g., bolts) and/or welding, and the panels 212 may also be connected to the outer support frame 202. For example, each of the panels 212 may be connected to adjacent panels 212, with only some of the panels 212 connected to the outer support frame 202 such that the outer support frame 202 supports the panels 212 of the inner shell 204. As the panels 212 of the inner shell 204 are supported by the outer support frame 202, the panels 212 may be replaced without sacrificing the structural integrity of the inner shell 204. For example, individual panels 212 may be replaceable, as needed, based upon use and wear, such as by having the damaged panels 212 cut away or unhinged and replaced with undamaged panels 212. During this replacement process, the inner shell 204 may distort and/or warp. Accordingly, the outer support frame 202 may provide additional structural support to the inner shell 204 to assist in the maintenance process of the furnace 200.

In addition to the outer support frame 202 and the inner shell 204, the furnace 200 may include one or more components included therein and/or operably coupled thereto. For example, with reference to FIGS. 2A, 2B, and 2C, the furnace 200 may include one or more exhaust flutes 214, one or more gas burners 216, and/or one or more air blowers 218. The gas burners 216 may be operably coupled and connected to the inner shell 204 of the furnace 202. As such, the gas burners 216 may be used to supply heat to the interior of the furnace 200, such as when heating material within the furnace 200. Further, the exhaust flutes 214 may be operably coupled and connected to the inner shell 204 of the furnace 202, such that gas, fumes, and/or other products from the interior of the furnace 200 may released through the exhaust flutes 214, as desired. One or more lines of tubing 220 may be used to provide gas to the gas burners 216. As such, and as shown particularly in FIG. 2C, the tubing 220 may be connected to and supported from the outer support frame 202.

Furthermore, the air blower 218 may be operably coupled and connected to the inner shell 204 of the furnace 200 such that air may be introduced from the exterior of the furnace 200 into the interior of the furnace 200. As shown in FIG. 2A in particular, a support base 222 may be used to support the air blower 218, in which the support base 222 may be connected to and extend from the outer support frame 202 of the furnace 200. Accordingly, the exhaust flutes 214, the gas burners 216, and/or the air blower 218 may be included within the furnace 200 to adequately control the temperature and heat differential within the furnace 200, as desired, such as when heating material within the furnace 200.

As discussed above, a furnace in accordance with the present disclosure may include one or more heat-resistant surfaces. As such, with respect to FIG. 2B, the furnace 200 may include a heat-resistant surface 224, such as a surface formed of or including hearth and/or other heat-resistant or heat-tolerant material. The heat-resistant surface 224 may include one or more ridges 226 formed therein, such as to facilitate receiving and removing material for the heat-resistant surface 224. Further, though only a bottom surface is shown as the heat resistant surface 224, the furnace 200 may include other heat resistant surfaces, such as one or more of the side surfaces or the upper surface, to facilitate heating material within the furnace 200.

Figure 2G:
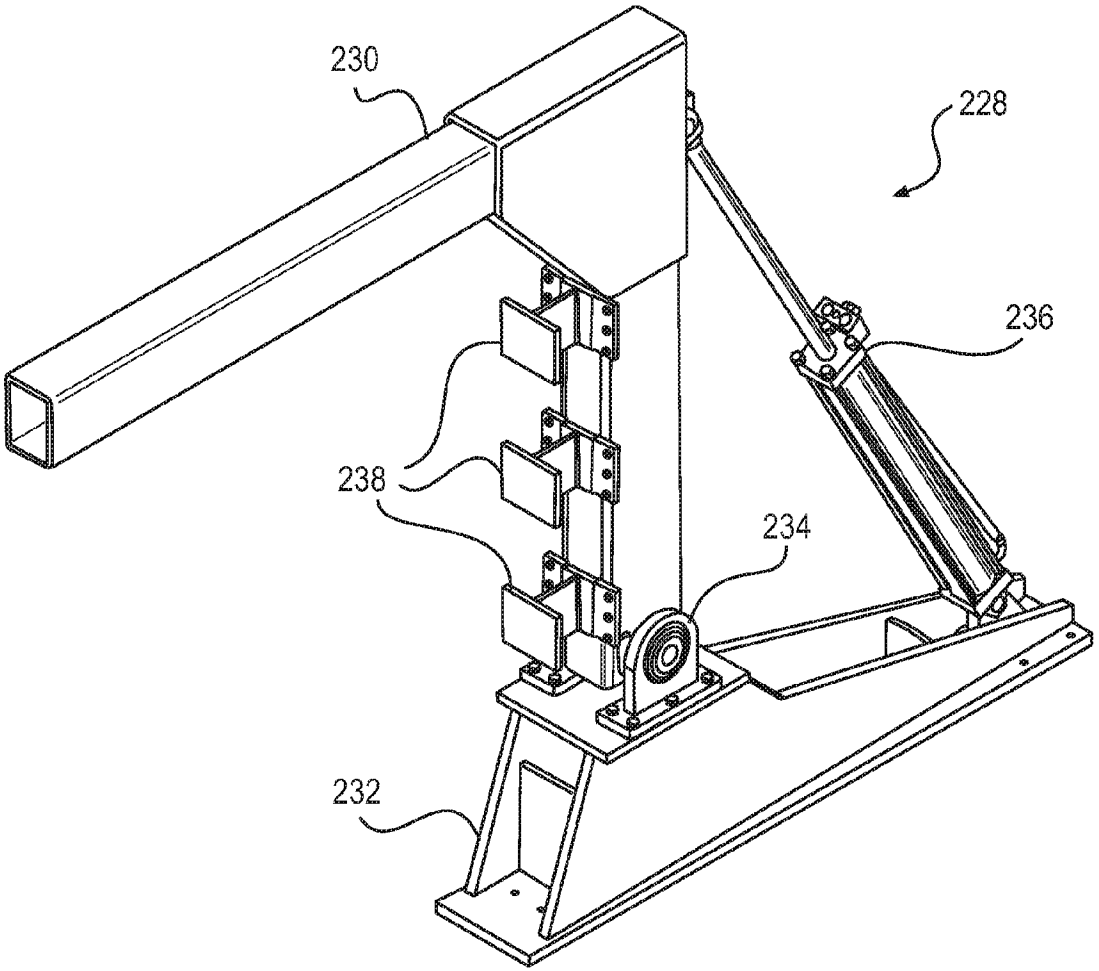
FIG. 2G shows a perspective view of an arm assembly of the furnace for heat treating material in accordance with one or more embodiments of the present disclosure.

To facilitate opening and closing the furnace 200, the furnace 200 may have one or more actuators and/or one or more arm assemblies operably coupled to the furnace 200. For example, with reference to FIG. 2G, an arm assembly 228 in accordance with the present disclosure is shown. The arm assembly 228 may include an arm 230 that connects to a base 232, in which the arm 230 may rotate about a hinge 234 with respect to the base 232. Further, the arm assembly 228 may include an actuator 236, such as a hydraulic actuator (e.g., cylinder), in which the actuator 236 is shown as connected between the arm 230 and the base 232 to control movement of the arm 230 with respect to the base 232. The arm assembly 228 may have one or more connection points 238, such as to connect to the outer support frame 202 of the furnace 200. In particular, as shown in FIG. 2A, the arm assembly 228 may connect to the top surface and/or one or more side surfaces of the outer support frame 202. Further, as shown, multiple arm assemblies 228 may be connected to the furnace 200 to facilitate opening and closing.

With respect to the above figures, the furnace 200 is shown to open and close by using a clamshell type action, in which the furnace 200 rotates about an axis of an offset hinge to move between the open and closed positions. However, the present disclosure is not so limited, as other types of action may be used to open and close a furnace without departing from the present disclosure. Further, though a hydraulic actuator is shown and discussed above, the present disclosure is not so limited, as other actuators, such as a pneumatic, electric, and/or mechanical actuator may be used without departing from the present disclosure. Further, those having ordinary skill in the art will appreciate that the present disclosure contemplates other arrangements and configurations for an arm assembly without departing from the present disclosure. For example, in one or more embodiments, a torque tube may be included within or between one or more arm assemblies, in which torque may be applied through the tube to the move the arm assemblies and the furnace between the open and closed positions. Accordingly, the present disclosure contemplates other embodiments than those specifically discussed or shown with respect to the above figures.

Referring now to FIGS. 3A-3D, multiple views of a quench tank 300 and components thereof in accordance with one or more embodiments of the present disclosure are shown. As discussed above, the quench tank 300 may include one or more agitators 302, such as to agitate the quenching medium included within the quench tank 300, particularly when material is within the quench tank 300 for quenching and cooling. As shown in FIGS. 1A-1L, one or more of the agitators 302 may be positioned along the length of the quench tank 300, and one or more of the agitators 302 may be positioned at one or both of the ends of the quench tank 300. For example, as the quench tank 300 may have a rectangular shape, such as when viewed from above in the embodiment shown in FIGS. 1A-1L, the quench tank 300 may have two longer sides and two shorter ends. In such an embodiment, one or more of the agitators 302 may be positioned along the length of the quench tank 300, and one or more of the agitators 302 may be positioned at one or both of the ends of the quench tank 300.

Figure 3A:
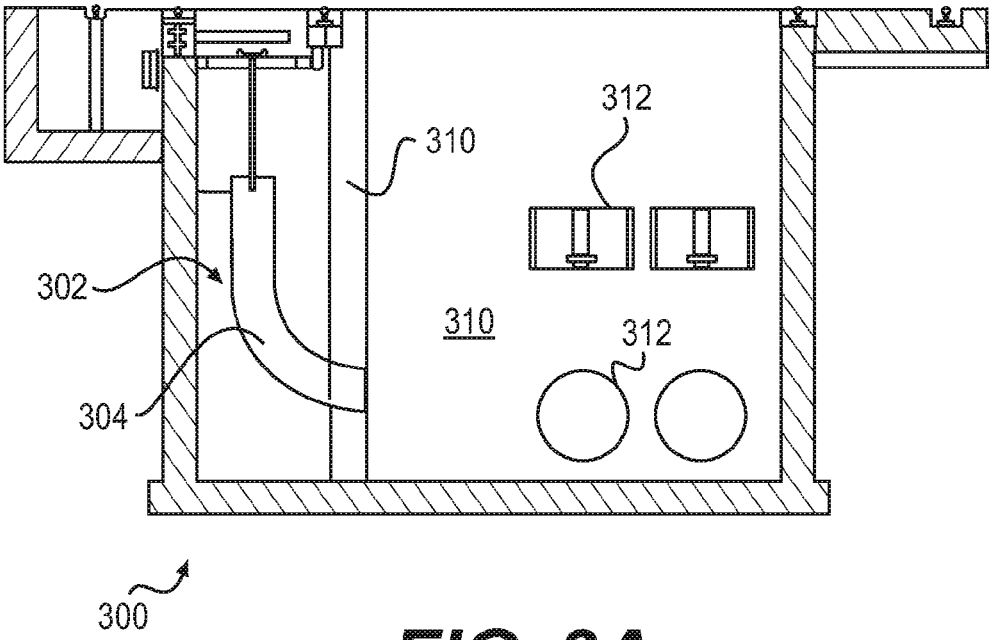
FIG. 3A shows a cross-sectional view of a quench tank of a system for heat treating material in accordance with one or more embodiments of the present disclosure.
Figure 3B:
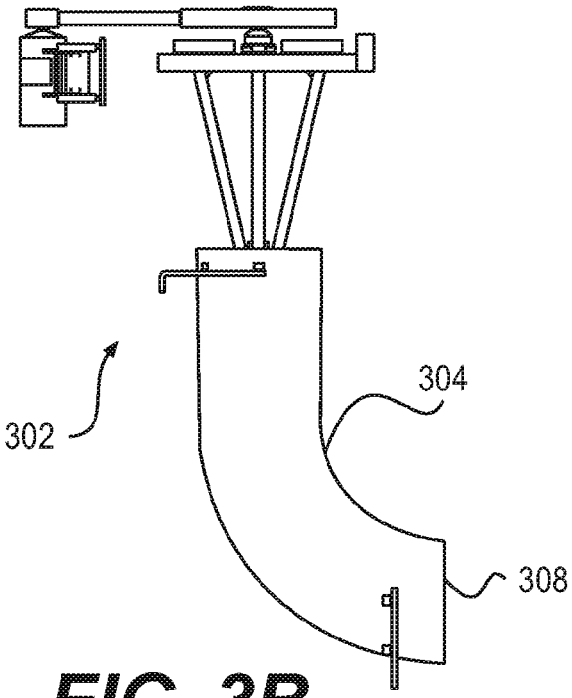
FIG. 3B shows a perspective view of an agitator included within a quench tank of a system for heat treating material in accordance with one or more embodiments of the present disclosure.
Figure 3C:
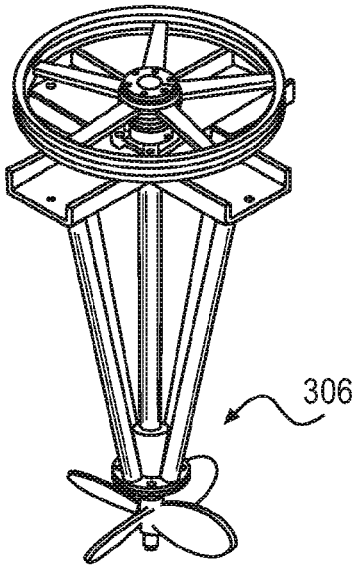
FIG. 3C shows a perspective view of an agitating mechanism included within a quench tank of a system for heat treating material in accordance with one or more embodiments of the present disclosure.
Figure 3D:
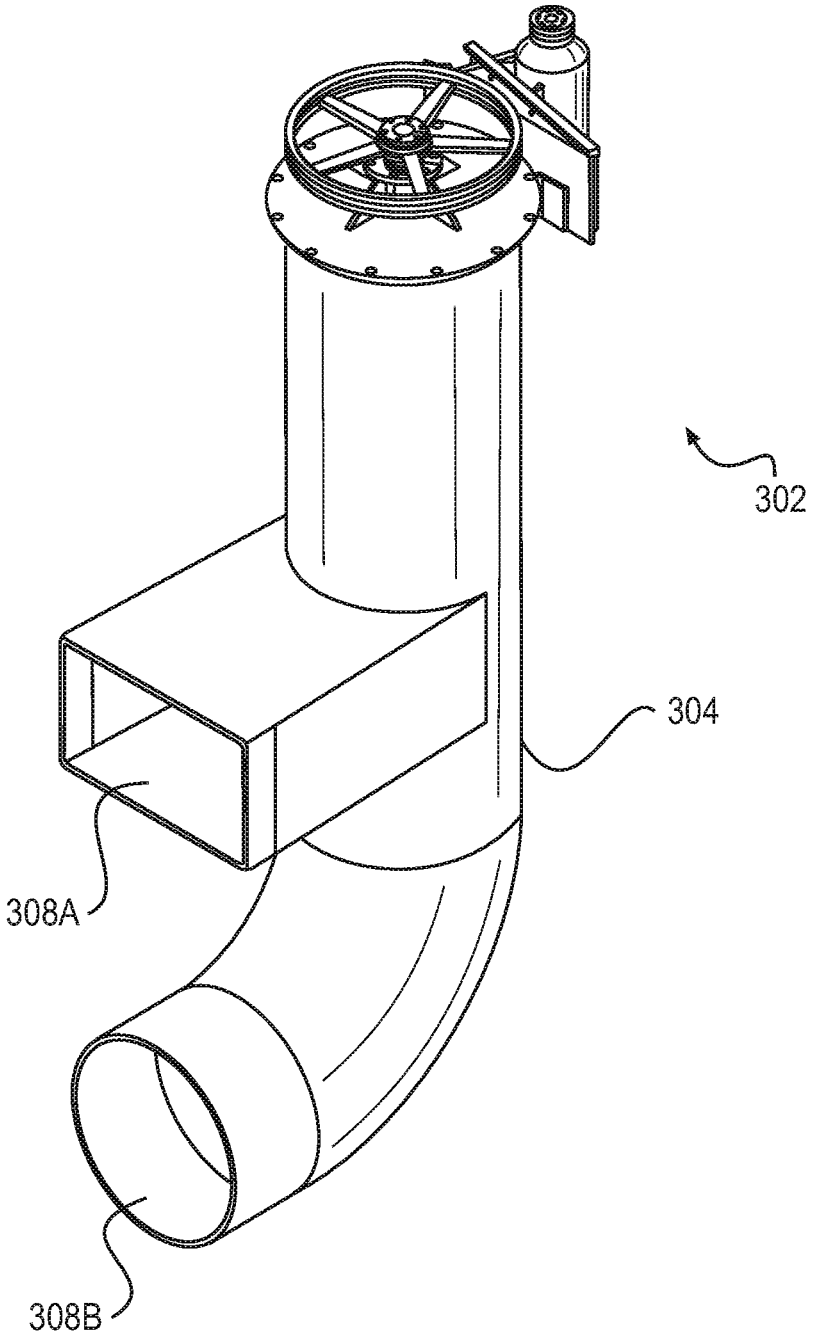
FIG. 3D shows a perspective view of an agitator included within a quench tank of a system for heat treating material in accordance with one or more embodiments of the present disclosure.

As shown in FIGS. 3B-3D, the agitator 302 may include a conduit 304 with an agitating mechanism 306, such as a propeller shown in FIG. 3C, included within the conduit 304. The conduit 304, which may be a J-tube, may include one or more ports 308, such as a single port 308 shown in FIG. 3B, or multiple ports 308 shown in FIG. 3D. In FIG.

3D, the conduit 304 of the agitator 302 is shown as having an upper port 308A and a lower port 308B, though other arrangements and configurations, such as side-by-side ports, may be used without departing from the scope of the present disclosure.

The quench tank 300 may further include one or more partitions 310 formed therein, such as positioned along the length of the quench tank 300 and/or at the ends of the quench tank 300. Accordingly, the partitions 310 may be used to support and/or protect the agitators 302. For example, the partitions 310 may have one or more windows 312 formed therein, such as corresponding to the location of the ports 308 of the agitators 302. As such, portions of the conduits 304 may be received within and/or extend through the windows 312 such that the ports 308 of the agitators 302 are able to agitate and expel fluid through the windows 312 of the partitions 310.

Referring now to FIGS. 4A-4J, multiple views of a manipulator assembly 400 and components thereof in accordance with one or more embodiments of the present disclosure are shown. As discussed above, the manipulator assembly 400 may be used to move material between different stations and points within a system for heat treating material in accordance with one or more embodiments of the present disclosure. As such, amongst other functions, the manipulator assembly 400 may be able to: move between a furnace, a quench tank, and/or a material loading station within the system; receive and dispatch material, such as from and into the furnace and/or the material loading station; and/or raise and lower material as desired within the system.

The manipulator assembly 400 may include one or more components to enable movement, such as to enable horizontal and/or vertical movement of material within the system with the manipulator assembly 400. As such, the manipulator assembly 400 may include a fork assembly 402, a transfer car 404, and/or a carriage frame 406. The fork assembly 402, as shown particularly in FIG. 4C, may be used to receive material into and dispatch material from the manipulator assembly 400. The fork assembly 402 may include one or more forks 408 and one or more base support members 410. The forks 408 may be connected to and extend from the base support members 410. In one or more embodiments, during use within a system of the present disclosure, the forks 408 of the fork assembly 402 may enter into the ridges of a heat-resistant surface, such as the heat-resistant surface 112 of the material loading station 110 or the heat-resistant surface 118 of the furnace 104, and lift from underneath the material to receive material from the material loading station and/or the furnace. As such, in one or more embodiments, the forks 408 may extend horizontally from the base support members 410 within the fork assembly 402, in which the fork assembly 402 may be able to move vertically within the manipulator assembly 400, such as to receive and dispatch material.

Figure 4A:
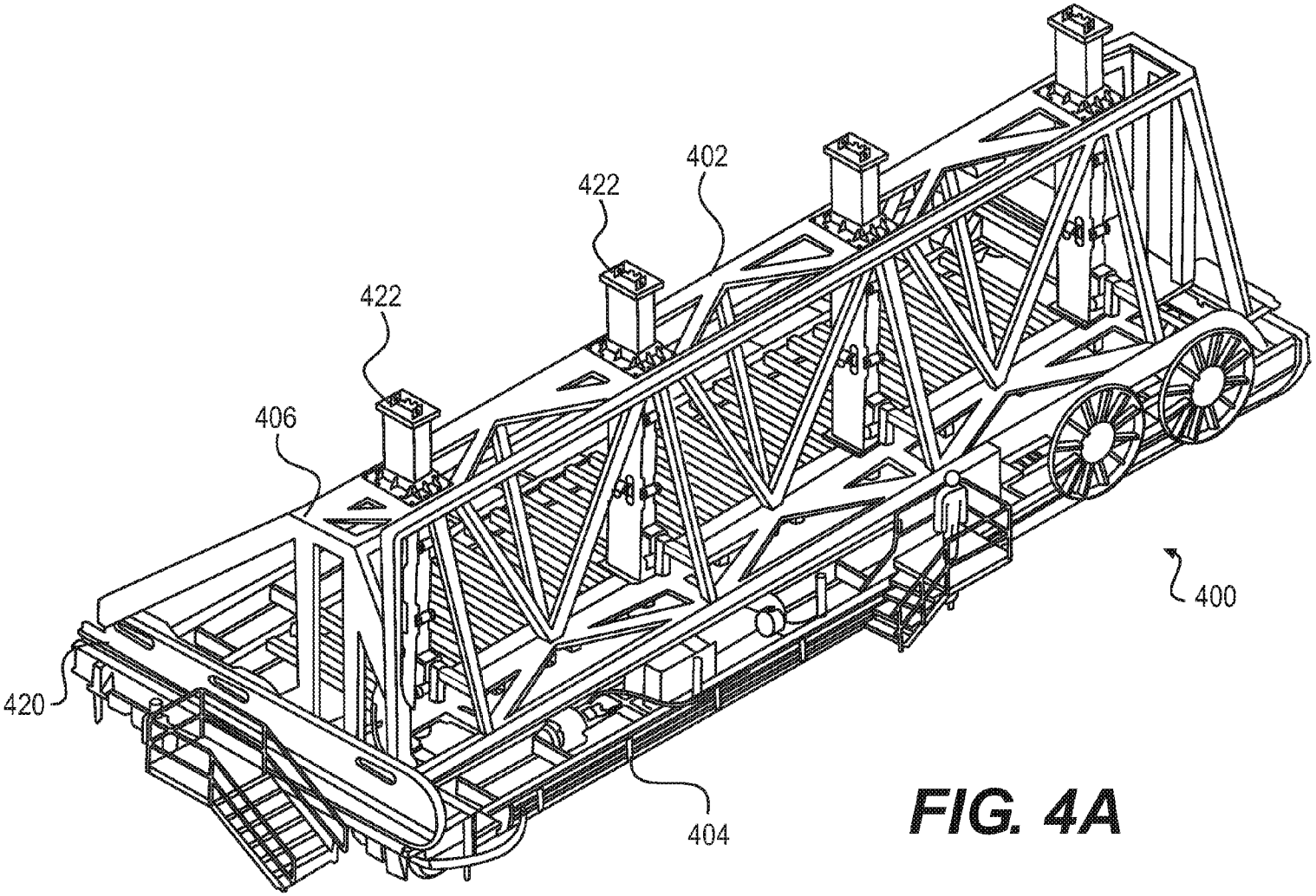
FIG. 4A shows an above perspective view of a manipulator assembly from a system for heat treating material in accordance with one or more embodiments of the present disclosure.
Figure 4B:
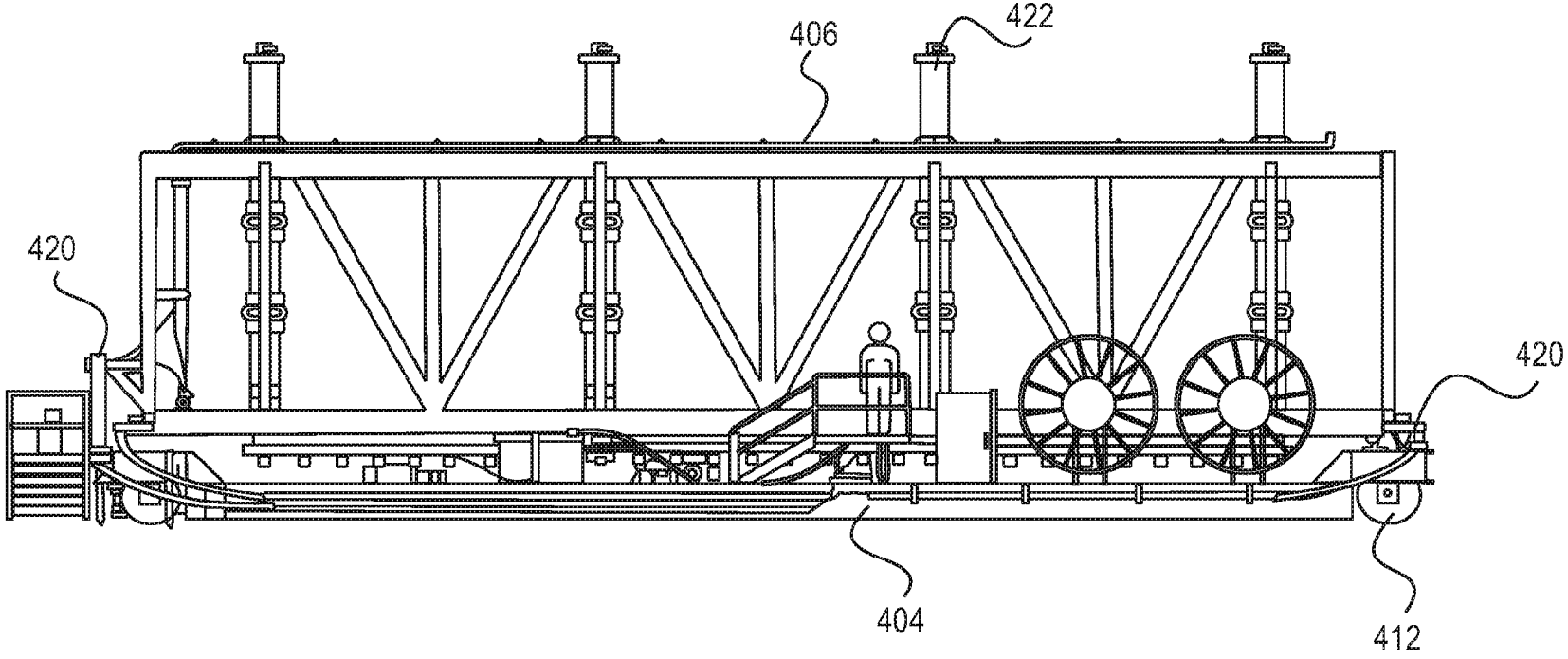
FIG. 4B shows a side view of a manipulator assembly from a system for heat treating material in accordance with one or more embodiments of the present disclosure.
Figure 4C:
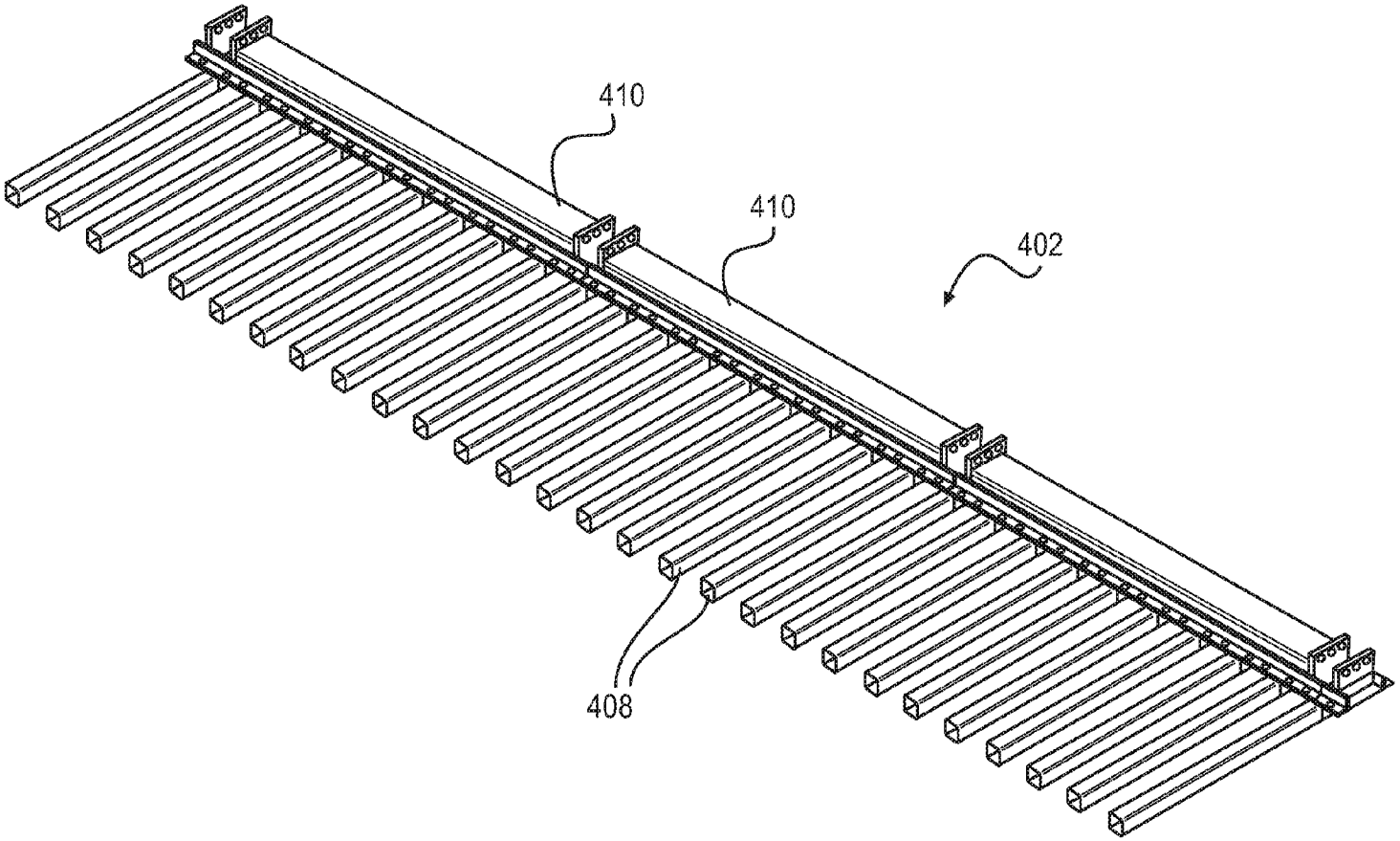
FIG. 4C shows an above perspective view of a fork assembly of the manipulator assembly from a system for heat treating material in accordance with one or more embodiments of the present disclosure.
Figure 4D:
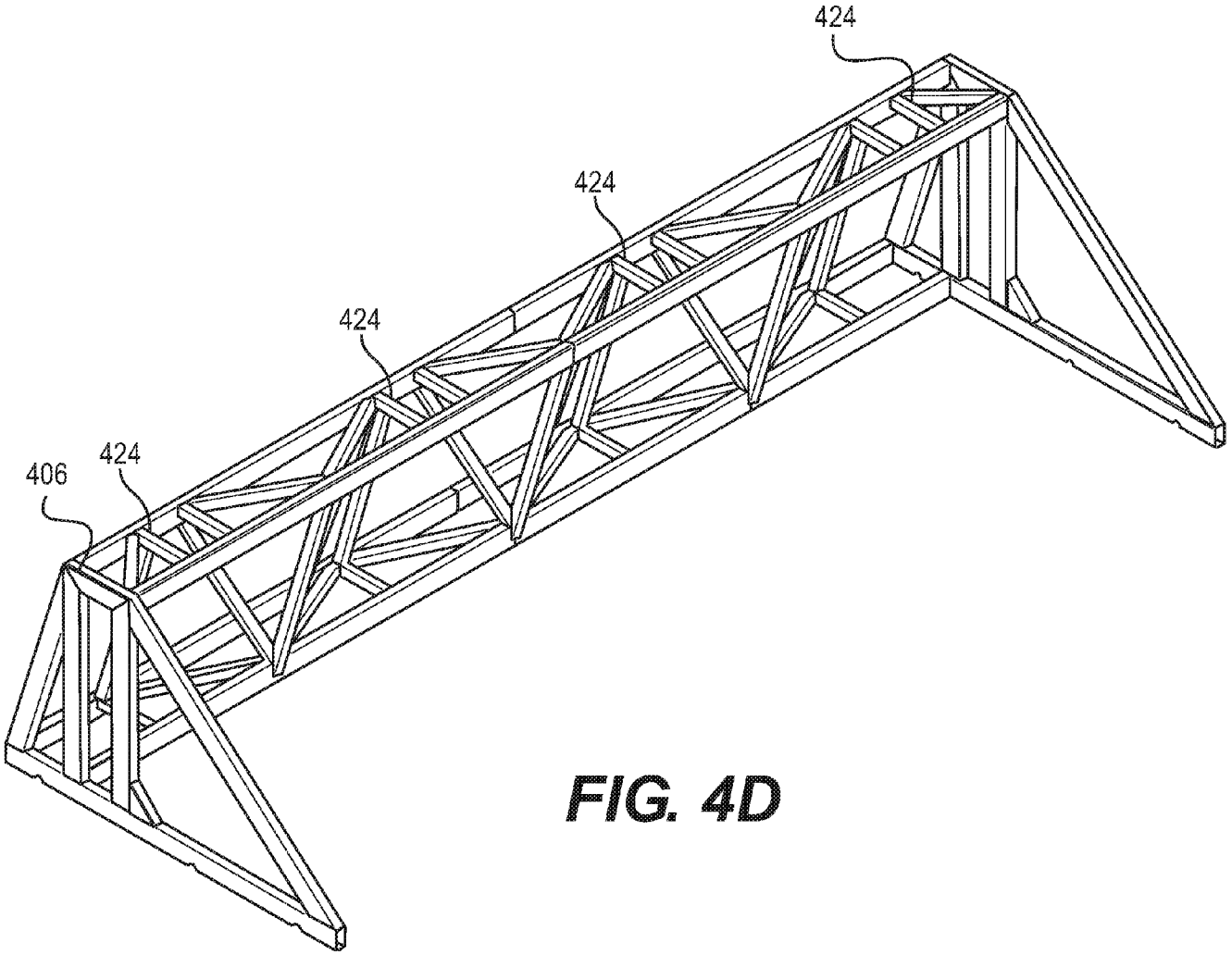
FIG. 4D shows an above perspective view of a carriage frame of the manipulator assembly from a system for heat treating material in accordance with one or more embodiments of the present disclosure.

The transfer car 404 may be used to move the manipulator assembly 400 within the system, such as move the manipulator assembly 400 between the furnace, the quench tank, and/or the loading station. For example, in an embodiment in which the system 100 includes tracks 116, as shown in FIG. 1A, the transfer car 404 may be able to move the manipulator assembly 400 along the tracks of the system. As such, and as shown in FIGS. 4G and 4H, the transfer car 404 may include one or more movement members 412, such as wheels in this embodiment, or anything other type of member known in the art, that may enable movement of the transfer car 404 and the manipulator assembly 400. The transfer car 404 may further include one or more base members 414 and one or more support members 416 connected to the base members 414. As shown in this embodiment, the movement members 412 may be connected to the support members 416, with the base members 414 extending between and connecting the support members 416.

Further, the carriage frame 406 may be used to support the fork assembly 402 and/or may be used to movably couple the fork assembly 402 to the transfer car 404. A detailed view of the carriage frame 406 is shown in FIG. 4D. As such, in one or more embodiments, the transfer car 404 may have tracks 418 included therewith and/or connected thereto, such as to enable movement of the fork assembly 402 and/or the carriage frame 406 with respect to the transfer car 404. As shown in FIGS. 4G and 4H, the tracks 418 may be positioned on and connected to the support members 416 of the transfer car 404, in which the fork assembly 402 and/or the carriage frame 406 may be able to move along the tracks 418. One or more movement members 420, such as a wheel assembly shown in FIGS. 4I and 4J, may then be positioned between the transfer car 404 and the fork assembly 402 and/or the carriage frame 406. As shown in FIGS. 4A and 4B, the movement members 420 may be positioned between the carriage frame 406 and the transfer car 404 to enable movement (e.g., horizontal movement) of the carriage frame 406 along the tracks 418 with respect to the transfer car 404. As the carriage frame 406 may be used to support the fork assembly 402, the fork assembly 402 may also be movable, such as in the horizontal direction, with respect to the transfer car 404.

As mentioned, the fork assembly 402 may be movable with respect to the transfer car 404, such as horizontally and/or vertically movable with respect to the transfer car 404. Accordingly, as the carriage frame 406 may be used to support the fork assembly 402 and/or may be used to movably couple the fork assembly 402 to the transfer car 404, the carriage frame 406 may include one or more actuators and/or other components to enable movement of the fork assembly 402 with respect to the carriage frame 406 and/or the carriage frame 406 with respect to the transfer car 404.

In one or more embodiments, one or more telescoping assemblies 422 may be coupled between the fork assembly 402 and the carriage frame 406 to move the fork assembly 402 with respect to the carriage frame 406, such as vertically move the fork assembly 402 with respect to the carriage frame 406. The carriage frame 406 may include one or more openings 424 formed therein to receive the telescoping assemblies 422 within the carriage frame 406. As such, the telescoping assemblies 422 may be positioned and inserted within the openings 424 to couple between the fork assembly 402 and the carriage frame 406.

Figure 4E:
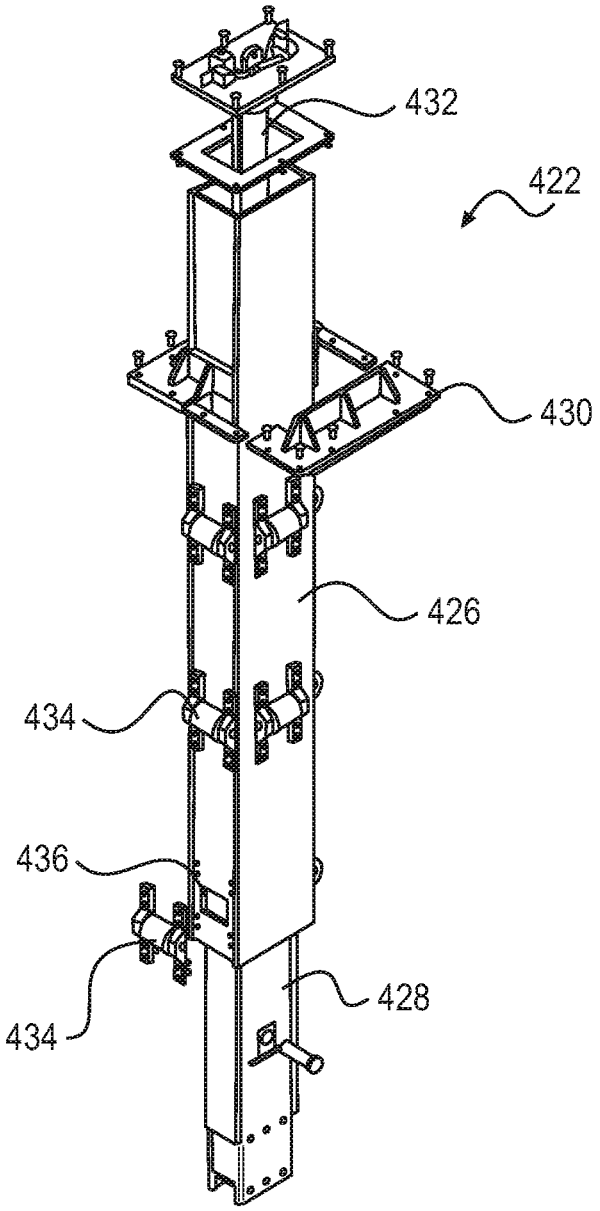
FIG. 4E shows an above perspective view of a telescoping assembly of the manipulator assembly from a system for heat treating material in accordance with one or more embodiments of the present disclosure.

A detailed view of the telescoping assembly 422 is shown in FIG. 4E. The telescoping assembly 422 may include an outer member 426 and an inner member 428 movably received within the outer member 426. An actuator 432 may then be positioned within the telescoping assembly 422 and connected between the outer member 426 and the inner member 428 to move the outer member 426 and the inner member 428 with respect to each other. In this embodiment, the outer member 426 is shown as an upper member, and the inner member 428 is shown as a lower member, though the present disclosure is not so limited. As such, in this embodiment, the outer member 426 may be coupled to the carriage frame 406, and the inner member 428 may be coupled to the fork assembly 402. Accordingly, a support bracket 430 may be included with the telescoping assembly 422, such as connected to or positioned about the outer member 426, to support, position, and/or connect the telescoping assembly 422 within the opening 424 of the carriage frame 406.

Further, one or more guiding members 434, such as rollers, may be used to facilitate and guide the movement of the outer member 426 with respect to the inner member 428. For example, in this embodiment, the outer member 426 may include one or more windows 436 formed therethrough, in which the guiding member 434 may be connected to the outer member 426 adjacent the window 436 to engage and guide the inner member 428 through the window 436. As such, the guiding members 434 may be positioned on opposite sides of the telescoping assembly 422 with respect to each other.

Figure 4F:
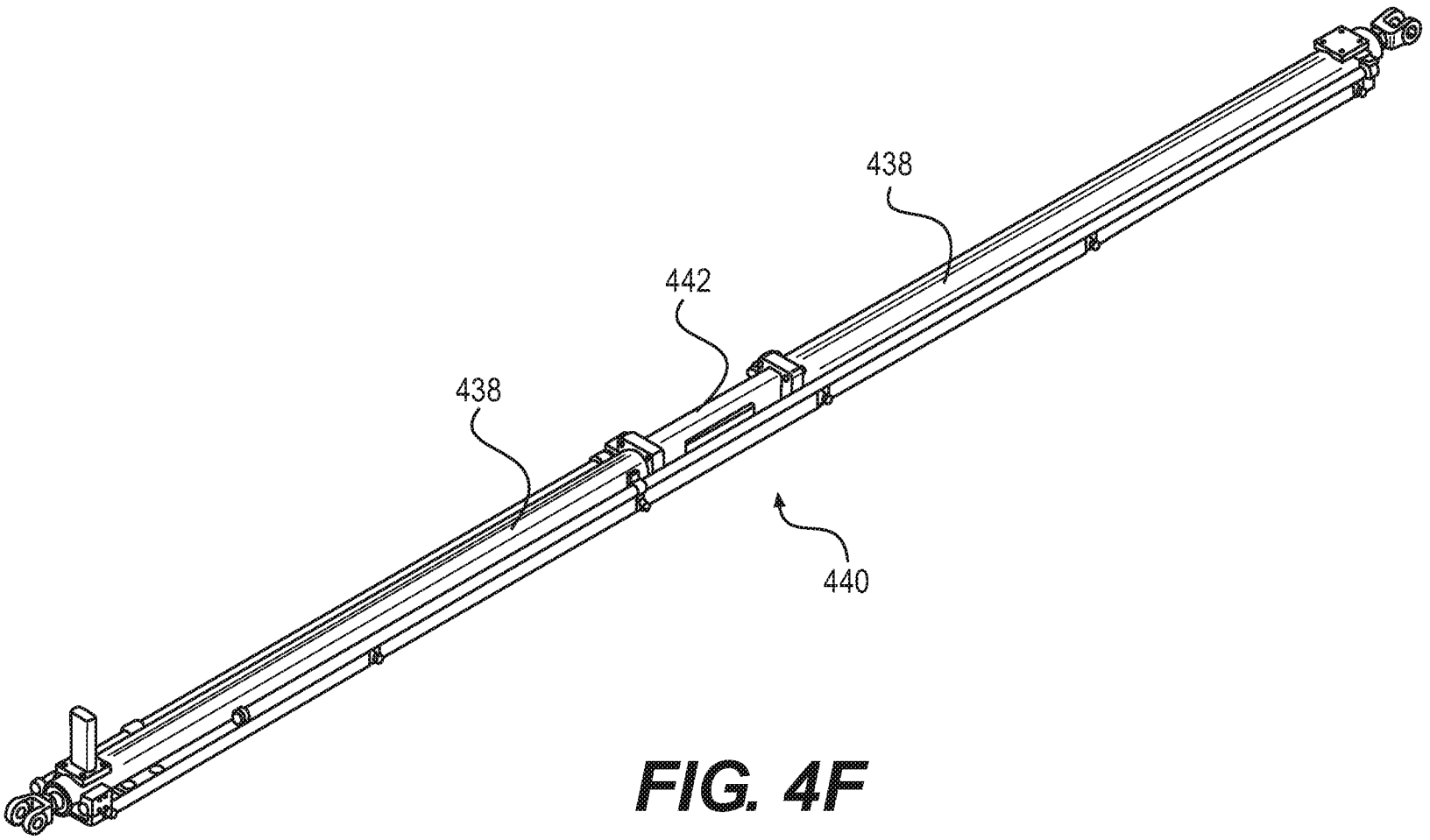
FIG. 4F shows an above perspective view of an actuator assembly of the manipulator assembly from a system for heat treating material in accordance with one or more embodiments of the present disclosure.
Figure 4G:
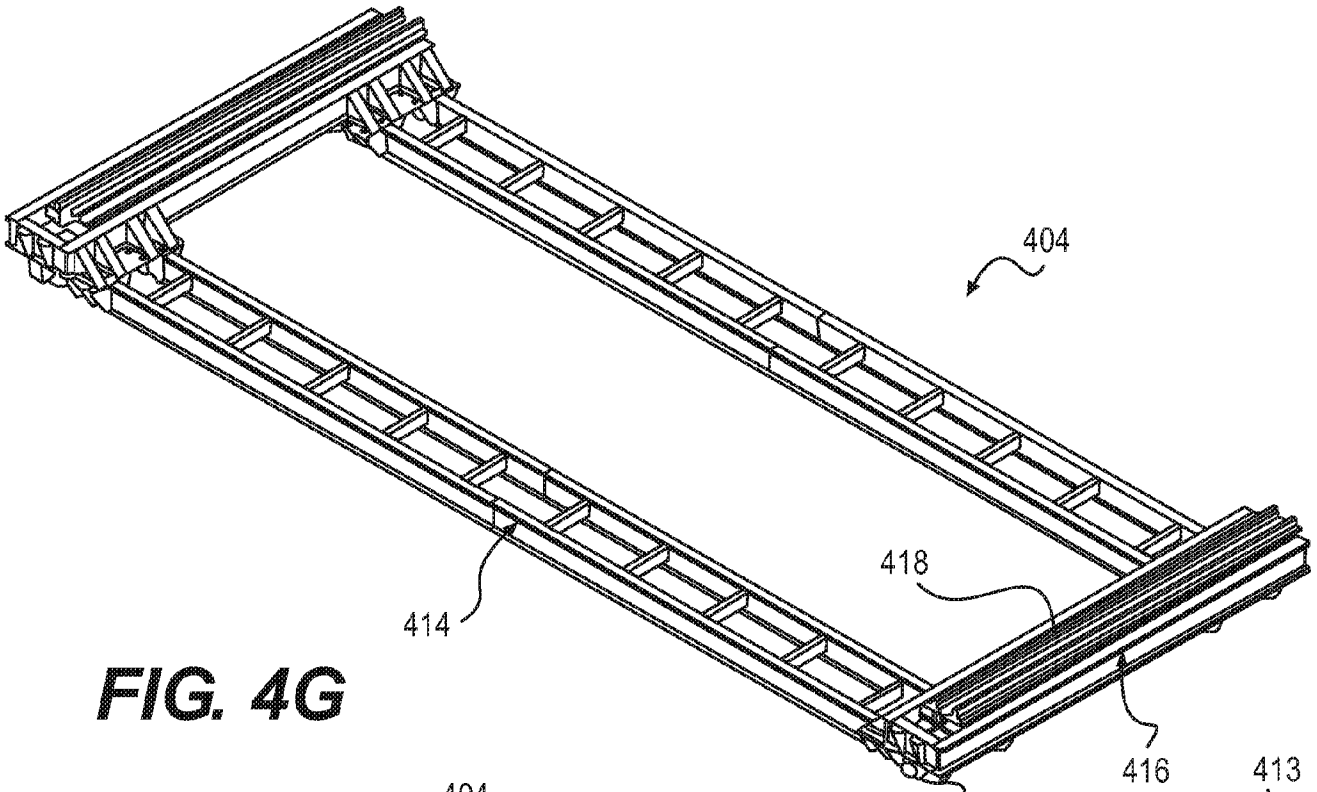
FIG. 4G shows an above perspective view of a transfer car of the manipulator assembly from a system for heat treating material in accordance with one or more embodiments of the present disclosure.
Figure 4H:
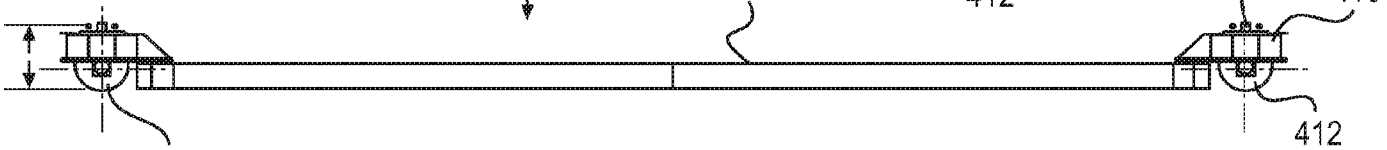
FIG. 4H shows a side view of a transfer car of the manipulator assembly from a system for heat treating material in accordance with one or more embodiments of the present disclosure.
Figure 4I:
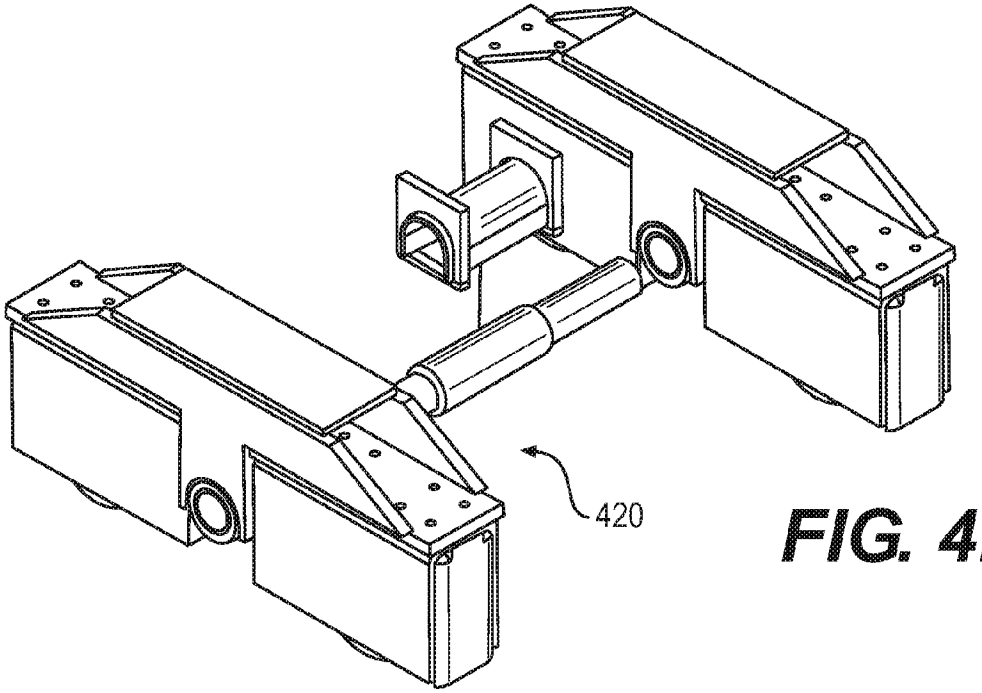
FIG. 4I shows an above perspective view of a movement member of the manipulator assembly from a system for heat treating material in accordance with one or more embodiments of the present disclosure.
Figure 4J:
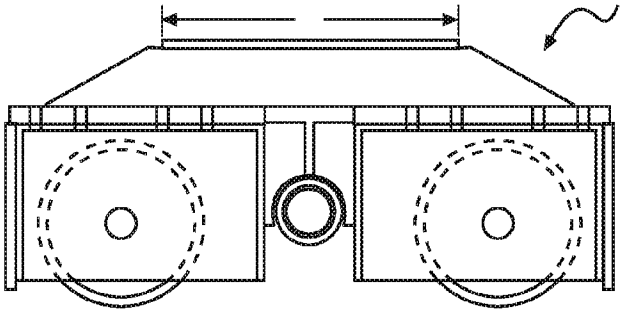
FIG. 4J shows a side view of the movement member of the manipulator assembly from a system for heat treating material in accordance with one or more embodiments of the present disclosure.

In accordance with one or more embodiments of the present disclosure, and as shown in FIG. 4F, one or more actuators 438 may be coupled between the carriage frame 406 and the transfer car 404 to move the carriage frame 406 with respect to the transfer car 404, such as horizontally move the carriage frame 406 with respect to the transfer car 404. An actuator assembly 440 is shown in FIG. 4F that includes multiple actuators 438. The actuators 438 are arranged in an end-to-end fashion. In particular, the actuators 438 may be hydraulic actuators that each include a cylinder with a piston rod movably received within and extending from the cylinder. As such, the cylinders of the actuators 438 may be arranged in an end-to-end fashion, in which the cylinders may be directly or indirectly connected to each other. As shown in FIG. 4F, the cylinders are indirectly connected to each other, as an adaptor 442 is positioned between the actuators 438 of the actuator assembly 440. As such, in this embodiment, one end of the actuator assembly 440 may couple to the carriage frame 406, and the other end of the actuator assembly 440 may couple to the transfer car 404, thereby enabling movement between the carriage frame 406 and the transfer car 404.

A furnace and a system for heat treating material in accordance with one or more embodiments may be capable of heat treating material, such as a metallic component, and more particularly a tubular member, having a length between about 25 feet (about 7.6 meters) and about 55 feet (about 16.8 meters). For example, the furnace, the quench tank, the manipulator assembly, and/or the material loading station discussed above may each be used to heat treat material having a length of about 55 feet or less. Each of these components, as described above, may be capable of handling material of such sizes due to the configuration used for each of the components. Further, the maintenance may be improved for such equipment. For example, when maintaining the furnace within the present disclosure, the panels of the inner shell may be replaced without sacrificing structural integrity of the furnace, as the outer support frame may be used to support the inner shell. Further, the telescoping assembly used to movably couple the fork assembly to the carriage frame may be replaced by removing the telescoping assembly from the opening of the carriage frame and inserting a replacement telescoping assembly within the opening of the carriage frame.

Although the present invention has been described with respect to specific details, it is not intended that such details should be regarded as limitations on the scope of the invention, except to the extent that they are included in the accompanying claims.

What is claimed is:

1. A furnace for heat treating material, comprising:
an outer support frame;
an inner shell connected to and at least partially received within the outer support frame;
the outer support frame and the inner shell being movable to open and close and to receive and remove material from the inner shell; and
an arm assembly connected to the outer support frame and comprising an actuator configured to open and close the outer support frame and the inner shell.

2. The furnace of claim 1, wherein the outer support frame comprises:
rib assemblies, each extending about at least a portion of the inner shell; and
support members connected across the rib assemblies to connect the rib assemblies to each other.

3. The furnace of claim 2, wherein:
each of the rib assemblies comprises a recess formed therein; and
the support members are supported from the recesses of the rib assemblies.

4. The furnace of claim 1, wherein the inner shell comprises replaceable panels connected to each other and connected to the outer support frame.

5. The furnace of claim 1, wherein the inner shell comprises:
an exhaust flute operably coupled thereto;
a gas burner operably coupled thereto; and
an air blower operably coupled thereto.

6. The furnace of claim 5, further comprising:
tubing connected to the outer support frame to provide gas to the gas burner; and
a support base connected to the outer support frame to support the air blower.

7. The furnace of claim 1, wherein:
the furnace further comprises a hearth surface included therein coverable by the inner shell; and
the hearth surface comprises ridges to facilitate receipt and removal of material on the hearth surface.

8. The furnace of claim 1, wherein the furnace is configured to rotate about an offset hinge to open and close.

9. The furnace of claim 1, wherein the inner shell is configured to receive material comprising a tubular member with a length between about 25 feet (about 7.6 meters) and about 55 feet (about 16.8 meters).

10. A system for heat treating a material, comprising:
a furnace comprising:
an outer support frame;
an inner shell connected to the outer support frame; and
wherein the furnace is movable to open and close to receive and remove the material therefrom;
a quench tank to receive the material;
a material loading station; and
a manipulator assembly configured to transport the material between the furnace, the quench tank, and the material loading station.

11. The system of claim 10, wherein the material loading station comprises a hearth surface comprising ridges to facilitate receipt and removal of the material on the hearth surface.

12. The system of claim 10, further comprising:
a track; and
wherein the manipulator assembly comprises:
a fork assembly configured to receive and dispatch the material from the manipulator assembly;
a transfer car configured to move the manipulator assembly along the track between the furnace, the quench tank, and the material loading station; and
a carriage frame configured to movably couple the fork assembly to the transfer car such that the fork assembly is movable within the manipulator assembly to receive and dispatch the material from the manipulator assembly.

13. The system of claim 12, wherein the manipulator assembly further comprises:

a telescoping assembly coupled between the fork assembly and the carriage frame to move the fork assembly with respect to the carriage frame such that the fork assembly is vertically movable with respect to the carriage frame; and an actuator coupled between the carriage frame and the transfer car to move the carriage frame with respect to the transfer car such that the carriage frame is horizontally movable with respect to the transfer car.

14. The system of claim 10, wherein:

the quench tank comprises agitators to agitate a quenching medium within the quench tank;

at least one of the agitators comprises a plurality of ports to agitate the quenching medium through each of the plurality of ports;

at least one of the agitators is positioned along a length of the quench tank; and at least one of the agitators is positioned at an end of the quench tank.

15. The system of claim 10, wherein:

the furnace outer support frame comprises:

rib assemblies, each extending about at least a portion of the inner shell; and support members connected across the rib assemblies to connect the rib assemblies to each other; and the inner shell of the furnace comprises replaceable panels connected to each other and connected to the outer support frame.

16. The system of claim 10, wherein the inner shell of the furnace comprises:

an exhaust flute operably coupled thereto;

a gas burner operably coupled thereto;

an air blower operably coupled thereto; and a hearth surface.

17. The system of claim 10, further comprising an arm assembly connected to the outer support frame and comprising an actuator to open and close the furnace.

18. The system of claim 10, wherein the inner shell is configured to receive the material comprising a tubular member with a length between about 25 feet (about 7.6 meters) and about 55 feet (about 16.8 meters).

19. A system for heat treating a material, comprising:

a furnace comprising:

an outer support frame;

an inner shell connected to the outer support frame;

an arm assembly connected to the furnace and comprising an actuator configured to open and close the furnace; and the furnace being movable to open and close to receive and remove the material from the furnace;

a quench tank configured to receive the material; and a manipulator assembly, at least a portion if which is moveable between the furnace and the quench tank, configured to transport the material between the furnace and the quench tank.

* * * * *